US005591567A

United States Patent [19]

Komatsu et al.

[11] Patent Number: 5,591,567

[45] Date of Patent: Jan. 7, 1997

[54] METHOD OF PROCESSING PHOTOGRAPHIC LIGHT-SENSITIVE MATERIAL

[75] Inventors: Hideki Komatsu; Shoji Nishio, both of Tokyo, Japan

[73] Assignee: Konica Corporation, Japan

[21] Appl. No.: 412,750

[22] Filed: Mar. 29, 1995

[30] Foreign Application Priority Data

Apr. 7, 1994 [JP] Japan ..... 6-069718

[51] Int. Cl.[6] ..... G03C 5/18; G03C 5/26; G03C 1/06

[52] U.S. Cl. ..... 430/399; 430/448; 430/264; 430/611; 430/613; 430/488; 430/963

[58] Field of Search ..... 430/448, 399, 430/264, 963, 611, 613, 505, 488, 491, 493

[56] References Cited

U.S. PATENT DOCUMENTS

| | | | |
|---|---|---|---|
| 3,432,298 | 3/1969 | von Rintelen et al. | 430/488 |
| 4,737,442 | 4/1988 | Yagihara et al. | 430/448 |
| 4,914,003 | 4/1990 | Yagihara et al. | 430/448 |
| 5,081,009 | 1/1992 | Tanemura et al. | 430/611 |
| 5,258,280 | 11/1993 | Suzuki | 430/611 |
| 5,385,811 | 1/1995 | Hirano | 430/488 |
| 5,415,973 | 5/1995 | Inoue | 430/611 |
| 5,457,009 | 10/1995 | Toyoda et al. | 430/611 |

FOREIGN PATENT DOCUMENTS

| | | | |
|---|---|---|---|
| 0529526 | 3/1993 | European Pat. Off. . | |
| 0529152 | 3/1993 | European Pat. Off. . | |
| 63-142352 | 6/1988 | Japan | 430/448 |
| 1-131545 | 5/1989 | Japan | 430/448 |
| 1-319031 | 12/1989 | Japan | 430/448 |
| 2-150840 | 6/1990 | Japan | 430/448 |
| 3-65950 | 3/1991 | Japan | 430/963 |
| 3-287252 | 12/1991 | Japan | 430/399 |

*Primary Examiner*—Anthony McFarlane
*Assistant Examiner*—J. Pasterczyk
*Attorney, Agent, or Firm*—Jordan B. Bierman; Bierman and Muserlian

[57] ABSTRACT

A method of processing a photographic light-sensitive material comprising a backing layer on a support opposite an emulsion layer comprises the steps of exposing the material, developing the exposed material with developer, the developer being replenished with developer replenisher in an amount of not more than 200 ml per $m^2$ of the material, and fixing the developed material, wherein the backing layer contains in an amount of 5 to 200 $mg/m^2$ a compound represented by the following Formula (1):

Formula (1)

6 Claims, No Drawings

METHOD OF PROCESSING PHOTOGRAPHIC LIGHT-SENSITIVE MATERIAL

FIELD OF THE INVENTION

The invention relates to a method of processing a silver halide photographic light-sensitive material, and particularly to a method of processing a silver halide photographic light-sensitive material which makes it possible in the rapid processing condition to reduce silver sludge which adheres to developing tanks or racks or rollers and to reduce a replenishing amount of processing solution replenisher.

BACKGROUND OF THE INVENTION

Recently, a scanner is widely used in the printing plate-making field. There are various processing apparatus using an image forming method by scanning. A light source used in these recording apparatus includes a glow lamp, xenon lamp, tungsten lamp, LED, a He—Ne laser, a argon laser or a semiconductor laser. A light sensitive material used in the scanner is required to have various photographic properties. It is essential that the light sensitive material have high sensitivity and high contrast, since short light-exposure time such as $10^{-3}$ to $10^{-7}$ seconds is carried out. In the printing industry high operation efficiency and high operation speed are strongly demanded, and here are needs for increasing a scanning speed and shortening the processing time of the light-sensitive material. The increase of the scanning speed, the increase of a beam number and less beam spots for a high image quality are required for an exposure device (a scanner, a plotter), and high sensitivity, excellent stability and rapid processability for a silver halide photographic light-sensitive material. The rapid processing referred to herein is a processing in which the total processing time is 15 to 60 seconds. The total processing time is a time taken from the entry of the leading edge of a film in the apparatus to the delivery of the leading edge out of the drying zone of the apparatus. The film is conveyed through the developing tank, the cross-over, the fixing tank, the cross-over, the washing tank, the cross-over and the drying zone in the automatic developing apparatus.

It is necessary to enhance developer activity for the rapid processing. The high content of a developing agent or high pH of developer increases the developer activity, but it leads to remarkable deterioration of the developer due to an air oxidation. The use of a large amount of sulfites are used to maintain the developer activity and prevention of the air oxidation of the developing agent. However, when a silver halide photographic light-sensitive material is processed with developer containing sulfites, which have a silver halide solubilizing capability, a large amount of silver halide are dissolved out of the material into the developer as silver complexes. These silver complexes in the developer are reduced to silver by a developing agent and the reduced silver adheres to and accumulates on a developing tank or vat or tanks and rollers of an automatic developing apparatus. These accumulated silver is called silver stains or silver sludge which adhere to the light sensitive material and give a damage to an image. Therefore, a periodical washing or maintenance of the apparatus is essential. In view of the above, the use of a large amount of sulfites produces much silver stains or sludges and has a defect There is a method for the rapid processing which reduces a binder content of a upper protective layer in the silver halide emulsion layer or increases a swelling degree of a hydrophilic colloid layer in a silver halide photographic light-sensitive material. However, this method increases the dissolution amount of silver halide, resulting in the silver stains.

Now, environmental problems are serious in the world, and solution thereof is earnestly desired in the photographic field. Most of photographic waste solutions are dumped into an ocean with incomplete treatment or without any treatment. Environmental deterioration caused by the dumping is a serious problem for a creature. Regulations for waste solutions will be severe in future, and it is expected that the waste solutions must be treated to a higher extent. In the photographic processing, the decrease of the waste solution amount is demanded in view of resource saving, less waste solutions and the decrease of vessels used, and various techniques therefor have been researched. As one of the most effective the decrease of developer replenisher amount is proposed.

However, it is well known that the decrease of a replenishing amount of a processing solution results in silver sludge occurrence due to the increase of a silver ion concentration. As a method for prevention of silver sludge occurrence the addition of a mercapto group-containing organic compound to developer is proposed, but there is a problem that the compound cannot be added to the developer in an amount sufficient to prevent the sludge on account of adverse affects on photographic properties such as desensitization. Particularly in view of rapid processing the addition amount is further restricted on account of lowering of developing activity. The mercapto group-containing organic compound is not satisfactory as an anti-sludging agent and solution of the problem is not reached.

In the light-sensitive material containing a hydrazine derivative or a tetrazolium compound there are problems such as deterioration of dot quality in an image and occurrence of black spots, which are not completely solved.

Thus, a method for processing a silver halide photographic light-sensitive material is strongly demanded, which has a rapid processing property and makes it possible to reduce silver sludge and the replenishing amount of replenisher, and to reduce black spots and improve dot quality.

SUMMARY OF THE INVENTION

An object of the invention is to provide a method for processing a silver halide photographic light-sensitive material, which makes it possible in the rapid processing condition to markedly reduce silver sludge and to reduce a replenishing amount of processing solution replenisher.

Another object of the invention is to provide a method for processing a silver halide photographic light-sensitive material, which makes it possible in the rapid processing condition to improve dot quality and to prevent occurrence of black spots.

DETAILED DESCRIPTION OF THE INVENTION

The above problems can be solved by the following:

(1) A method of processing a photographic light-sensitive material comprising a backing layer, developer being replenished with developer replenisher in an amount of not more than 200 ml per $m^2$ of the material, wherein the backing layer contains in an amount of 5 to 200 $mg/m^2$ a compound represented by the following Formula (1):

(2) The method of (1) above, wherein the backing layer contains in an amount of 7 to 150 mg/m$^2$ the compound represented by said Formula (1).

(3) The method of (1) or (2) above, wherein the developer is replenished with developer replenisher in an amount of 50 to 160 ml per m$^2$ of the material.

(4) The method of (1), (2) or (3) above, wherein the total processing time is 15 to 60 seconds.

Formula (1)

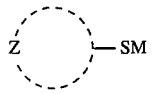

The present invention will be detailed below,

Now, compounds represented by Formula (1) will be explained.

In Formula, the heterocyclic ring includes an oxazole, benzoxazole, thiazole, benzothiazole, triazine, pyrimidine, tetraazaindolidine, triazaindene or purine ring, and preferably a 5- or 6-membered heterocyclic ring which may be condensed with a benzene ring. M represents a hydrogen atom, an alkali metal atom, an alkali earth metal atom or a cation such as an ammonium ion. The heterocyclic ring may have a substituent other than —SH, and the substituent includes a halogen atom, a sulfo group, a hydroxy group, a lower alkyl group having 1 to 5 carbon atoms or a phenyl group.

Exemplified compounds represented by Formula (1) will be shown, but not limited thereto.

[1-1]

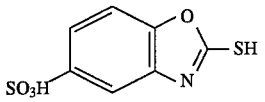

[1-2]

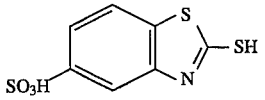

[1-3]

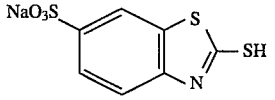

[1-4]

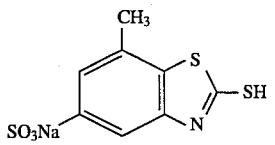

[1-5]

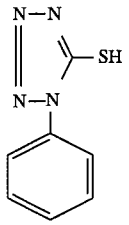

[1-6]

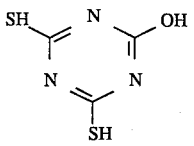

-continued

[1-7]

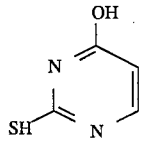

[1-8]

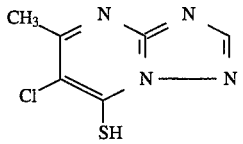

[1-9]

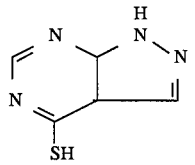

[1-10]

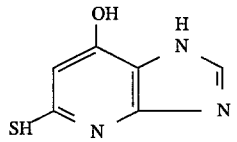

[1-11]

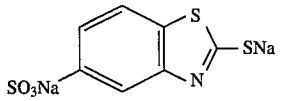

The compounds represented by Formula (1) preferably have a chemical structure represented by Formula (A) through (C).

The compounds having a chemical structure represented by Formula (A) will be explained.

Formula (A)

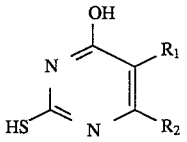

In Formula, $R_1$ and $R_2$ independently represent an alkyl, aryl, aralkyl, hydroxy, carboxy, sulfo, phosphono, amino, nitro, cyano, alkoxycarbonyl, aryloxycarbonyl, carbamoyl, sulfamoyl or alkoxy group or a halogen atom.

The alkyl, aryl, aralkyl, amino, alkoxycarbonyl, aryloxycarbonyl, carbamoyl, sulfamoyl or alkoxy group may have a further substituent and the substituent includes the same as the group represented by $R_1$ or $R_2$. $R_1$ and $R_2$ may combine to form a ring. One of $R_1$ and $R_2$ preferably represents a substituted or unsubstituted alkyl group having 1 to 10 carbon atoms, a substituted or unsubstituted aryl group having 6 to 12 carbon atoms, a substituted or unsubstituted aralkyl group having 7 to 12 carbon atoms, a nitro group, a cyano group or a halogen atom. $R_1$ or $R_2$ preferably combines to form a saturated 5-membered.

$R_1$ more preferably represents a hydrogen atom or an alkyl group having as a substituent an amino group (such as a dimethylamino or diethylamino group) or a heterocyclic ring group (such as a morpholino, N-methylpiperadinyl, pyrrolidinyl or piperidinyl group). $R_2$ more preferably represents a substituted or unsubstituted alkyl group having 1 to 10 carbon atoms, a substituted or unsubstituted aryl group having 6 to 12 carbon atoms. Concretely, $R_1$ represents dimethylaminomethyl, morpholinomethyl, N-methylpiperadinylmethyl or pyrrolidinylmethyl group. $R_2$ represents a methyl, ethyl, phenyl or p-methoxymethyl group.

Exemplified compounds represented by Formula (A) will be shown, but not limited thereto.

[A-1]
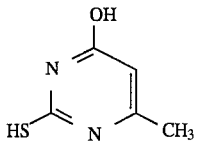
[A-2]
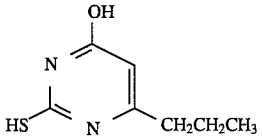
[A-3]
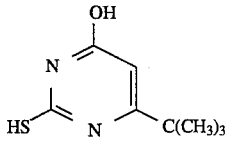
[A-4]
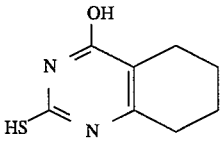
[A-5]
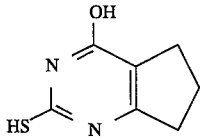
[A-6]
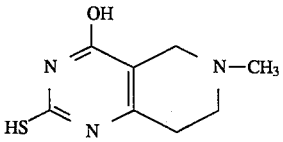
[A-7]
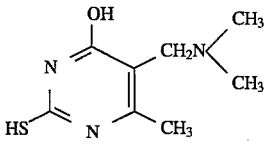
[A-8]
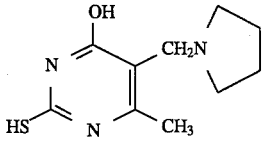
[A-9]
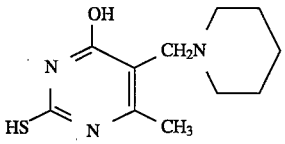
[A-10]
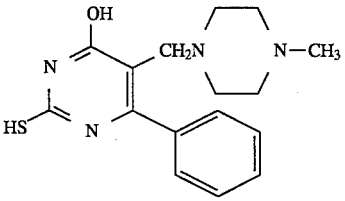
-continued
[A-11]
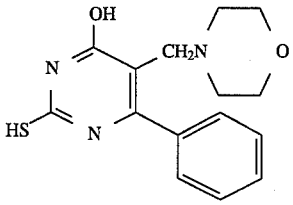
[A-12]
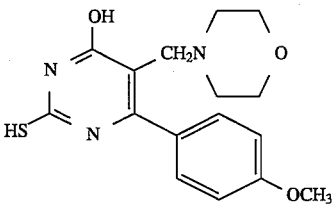
[A-13]
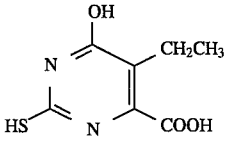
[A-14]
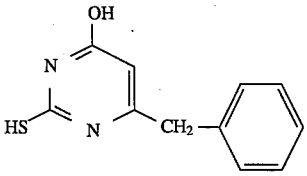
[A-15]
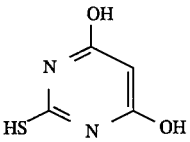
[A-16]
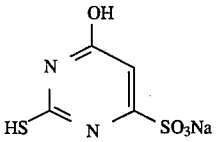
[A-17]
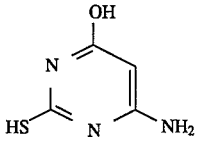
[A-18]
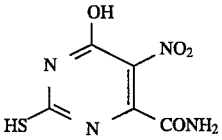
[A-19]
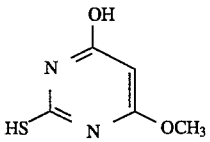
[A-20]
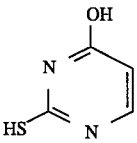

The compounds having a chemical structure represented by Formula (B) will be explained.

Formula (B)

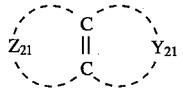

In Formula (B) in the invention $Z_{21}$ and $Y_{21}$ independently represent an atomic group necessary to form an unsaturated 5- or 6-membered ring, (such as pyrrole, imidazole, pyrazole, pyrimidine and pyridamine), provided that three or more nitrogen atoms are contained in $Z_{21}$ and $Y_{21}$ and one of $Z_{21}$ and $Y_{21}$ has a mercapto group as a substituent. Compound represented by Formula (B) may have a substituent other than a mercapto group, including, for example, a halogen atom (such as fluorine, chlorine and bromine), a lower alkyl group (including those having a substituent and, preferably, those having not more than 5 carbon atoms such as a methyl group and an ethyl group), a lower alkoxy group (including those having a substituent and, preferably, those having not more than 5 carbon atoms such as methoxy, ethoxy and butoxy), a hydroxy group, a sulfo group, a lower allyl group (including those having a substituent and, preferably, those having not more than 5 carbon atoms), an amino group, a $COOM_{21}$ group (in which $M_{21}$ represents a hydrogen atom, an alkali-metal atom or an ammonium group), a carbamoyl group and a phenyl group. The substituent is particularly preferably a hydroxy group, a $COOM_{21}$ group, an amino group or a sulfo group.

In Formula (B), the compounds represented by the following formulas (a) through (f) are particularly preferable.

Formula (a)

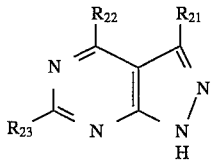

In Formula, $R_{21}$, $R_{22}$ and $R_{23}$ independently represent a halogen atom, a lower alkyl group (including those having a substituent and preferably, those having not more than 5 carbon atoms such as a methyl group and an ethyl group), a lower alkoxy group (including those having a substituent and preferably, those having not more than 5 carbon atoms ), a hydroxy group, a sulfo group, a lower allyl group (including those having a substituent and preferably, those having not more than 5 carbon atoms), an amino group, a $COOM_{21}$ group (in which $M_{21}$ represents the same group as M defined in the above Formula (1)), a carbamoyl group or a phenyl group, provided that one of $R_{21}$, $R_{22}$ and $R_{23}$ is a mercapto group. In the compounds represented by Formula (a) the group other than a mercapto group is preferably a hydroxy group, a $COOM_{21}$ group, an amino group or a sulfo group.

Formula (b)

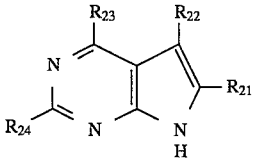

In Formula, $R_{21}$, $R_{22}$, $R_{23}$ and $R_{24}$ independently represent a halogen atom, a lower alkyl group (including those having a substituent and preferably, those having not more than 5 carbon atoms such as a methyl group and an ethyl group), a lower alkoxy group (including those having a substituent and preferably, those having not more than 5 carbon atoms), a hydroxy group, a sulfo group, a lower allyl group (including those having a substituent and preferably, those having not more than 5 carbon atoms), an amino group, a $COOM_{21}$ group (in which $M_{21}$ represents the same group as M defined in the above Formula (1)), a carbamoyl group or a phenyl group, provided that one of $R_{21}$, $R_{22}$, $R_{23}$ and $R_{24}$ is a mercapto group. In the compounds represented by Formulas (b) the group other than a mercapto group is preferably a hydroxy group, a $COOM_{21}$ group, an amino group or a sulfo group.

Formula (c)

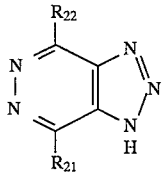

In Formula, $R_{21}$ and $R_{22}$ independently represent a halogen atom, a lower alkyl group (including those having a substituent and preferably, those having not more than 5 carbon atoms such as a methyl group and an ethyl group), a lower alkoxy group (including those having a substituent and preferably, those having not more than 5 carbon atoms), a hydroxy group, a sulfo group, a lower allyl group (including those having a substituent and preferably, those having not more than 5 carbon atoms), an amino group, a $COOM_{21}$ group (in which $M_{21}$ represents the same group as M defined in the above Formula (1)), a carbamoyl group or a phenyl group, provided that one of $R_{21}$ and $R_{22}$ is a mercapto group. In the compounds represented by Formula (c) the group other than a mercapto group is preferably a hydroxy group, a $COOM_{21}$ group, an amino group or a sulfo group.

Formula (d)

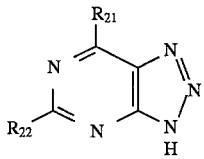

In Formula, $R_{21}$ and $R_{22}$ independently represent a halogen atom, a lower alkyl group (including those having a substituent and preferably, those having not more than 5 carbon atoms such as a methyl group and an ethyl group), a lower alkoxy group (including those having a substituent and preferably, those having not more than 5 carbon atoms), a hydroxy group, a sulfo group, a lower allyl group (including those having a substituent and preferably, those having not more than 5 carbon atoms), an amino group, a $COOM_{21}$ group (in which $M_{21}$ represents the same group as M defined in the above Formula (1)), a carbamoyl group or a phenyl group, provided that one of $R_{21}$ and $R_{22}$ is a mercapto group. In the compounds represented by Formula (d) the group other than a mercapto group is preferably a hydroxy group, a $COOM_{21}$ group, an amino group or a sulfo group.

Formula (e)

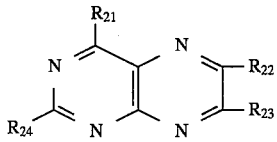

In Formula, $R_{21}$, $R_{22}$, $R_{23}$ and $R_{24}$ independently represent a halogen atom, a lower alkyl group (including those having a substituent and preferably, those having not more than 5 carbon atoms such as a methyl group and an ethyl group), a lower alkoxy group (including those having a substituent and preferably, those having not more than 5 carbon atoms), a hydroxy group, a sulfo group, a lower allyl group (including those having a substituent and preferably, those having not more than 5 carbon atoms), an amino group, a $COOM_{21}$ group (in which $M_{21}$ represents the same group as M defined in the above Formula (1)), a carbamoyl group or a phenyl group, provided that one of $R_{21}$, $R_{22}$ and $R_{23}$ is a mercapto group. In the compounds represented by Formulas (e) the group other than a mercapto group is preferably a hydroxy group, a $COOM_{21}$ group, an amino group or a sulfo group.

Formula (f)

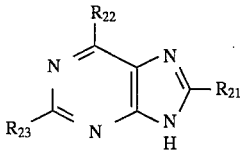

In Formula, $R_{21}$, $R_{22}$ and $R_{23}$ independently represent a hydrogen atom, $—SM_{21}$, a hydroxy group, a lower alkoxy group, $–COOM_{21}$, an amino group, $—SO_3M_{23}$ or a lower alkyl group, provided that one of $R_{21}$, $R_{22}$ and $R_{23}$ is $—SM_{21}$; wherein $M_{21}$, $M_{22}$ and $M_{23}$ independently represent a hydrogen atom, an alkali metal atom or an ammonium group and may be the same or different.

In Formula (f) the lower alkoxy or alkyl group represented by $R_{21}$, $R_{22}$ and $R_{23}$ has a group having 1–5 carbon atoms and preferably 1–3 carbon atoms which may have a substituent. The amino group represented by $R_{21}$, $R_{22}$ and $R_{23}$ represents a substituted or unsubstituted amino group. The substituent thereof is preferably a lower alkyl group.

In Formula (f) the ammonium group represents a substituted or unsubstituted ammonium group, and preferably an unsubstituted ammonium group.

The concrete examples of the compounds represented by Formulas (a) to (f) will be given below. However, the invention shall not be limited thereto.

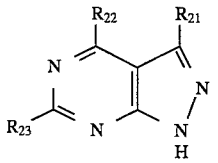

| | $R_{21}$ | $R_{22}$ | $R_{23}$ |
|---|---|---|---|
| B-1 | H | H | SH |
| B-2 | H | SH | H |
| B-3 | $CH_3$ | H | SH |
| B-4 | OH | H | SH |
| B-5 | H | $NH_2$ | SH |
| B-6 | Cl | SH | H |
| B-7 | COOH | H | SH |

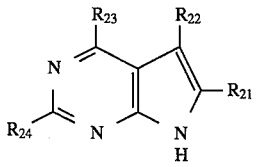

| | $R_{21}$ | $R_{22}$ | $R_{23}$ | $R_{24}$ |
|---|---|---|---|---|
| B-8 | H | H | H | SH |
| B-9 | Cl | H | H | SH |
| B-10 | SH | H | H | H |
| B-11 | $nC_5H_{11}$ | H | H | SH |
| B-12 | OH | H | H | SH |
| B-13 | H | H | OH | SH |
| B-14 | SH | H | SH | H |

-continued

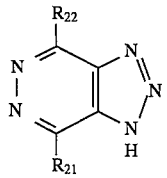

| | $R_{21}$ | $R_{22}$ |
|---|---|---|
| B-15 | SH | H |
| B-16 | SH | SH |
| B-17 | SH | COOH |
| B-18 | SH | $SO_3H$ |
| B-19 | SH | OH |

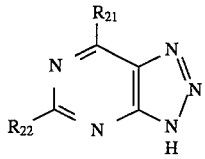

| | $R_{21}$ | $R_{22}$ |
|---|---|---|
| B-20 | SH | H |
| B-21 | SH | SH |
| B-22 | SH | COOH |
| B-23 | SH | $SO_3H$ |
| B-24 | SH | OH |

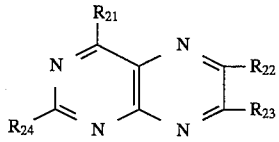

| | $R_{21}$ | $R_{22}$ | $R_{23}$ | $R_{24}$ |
|---|---|---|---|---|
| B-25 | H | H | H | SH |
| B-26 | H | H | SH | SH |
| B-27 | OH | H | H | SH |
| B-28 | H | $C_5H_{11}$ | H | SH |
| B-29 | SH | COOH | H | H |
| B-30 | H | H | $SO_3H$ | SH |

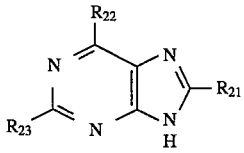

| | $R_{21}$ | $R_{22}$ | $R_{23}$ |
|---|---|---|---|
| B-31 | H | H | SH |
| B-32 | H | SH | OH |
| B-33 | $CH_3$ | H | SH |
| B-34 | OH | H | SH |
| B-35 | H | OH | SH |
| B-36 | Cl | SH | H |
| B-37 | COOH | H | SH |
| B-38 | H | $NH_2$ | SH |
| B-39 | SH | OH | H |

The compounds having a chemical structure represented by Formula (C) will be explained.

Formula (C)

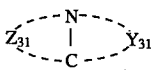

In Formula, $Z_{31}$ and $Y_{31}$ independently represent an atomic group necessary to form an unsaturated 5- or 6-membered ring, provided that 3 or more nitrogen atoms are contained in $Z_{31}$ and $Y_{31}$ and one of $Z_{31}$ and $Y_{31}$ has a mercapto group as a substituent.

Of compounds represented by Formula (C) compounds selected from those represented by Formulas (g) and (h) are preferable.

Formula (g)

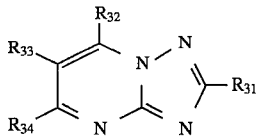

Formula (h)

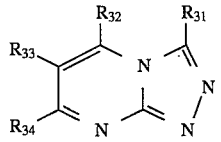

In Formulas (g) and (h) $R_{31}$, $R_{32}$, $R_{33}$ and $R_{34}$ independently represent a hydrogen atom, —$SM_{31}$, a hydroxy group, a lower alkoxy group, —$COOM_{32}$, an amino group, —$SO_3M_{33}$ or a lower alkyl group, provided that one of $R_{31}$, $R_{32}$, $R_{33}$ and $R_{34}$ has a —$SM_{31}$ as a substituent wherein $M_{31}$, $M_{32}$ and $M_{33}$ independently represent a hydrogen atom, an alkali metal atom or an ammonium and may be the same or different.

In Formulas (g) and (h) the lower alkyl group or lower alkoxy group represented by $R_{31}$, $R_{32}$, $R_{33}$ or $R_{34}$ has 1 to 5 carbon atoms which may have a substituent, and preferably has 1 to 3 carbon atoms. The amino group represented by $R_{31}$, $R_{32}$, $R_{33}$ or $R_{34}$ represents a substituded or unsubstituded amino group, and preferably represents an amino group having a lower alkyl group.

Examplified compounds represented by Formulas (g) and (h) will be shown, but not limited thereto.

| | $R_{31}$ | $R_{32}$ | $R_{33}$ | $R_{34}$ |
|---|---|---|---|---|
| Exemplified compounds represented by Formula (g) | | | | |
| g-1 | —SH | H | H | H |
| g-2 | —SH | —OH | H | H |
| g-3 | —SH | H | —OH | H |
| g-4 | —SH | —$CH_3$ | —OH | H |
| g-5 | —SH | —$NH_2$ | H | H |
| g-6 | —SH | H | H | —$NH_2$ |
| g-7 | —SH | H | —$CH_3$ | —$CH_3$ |
| g-8 | —SH | H | H | —SH |
| g-9 | —SH | —OH | H | —SH |
| g-10 | —SH | H | H | —COOH |
| g-11 | H | —SH | H | H |
| g-12 | —SH | —SH | H | H |
| g-13 | H | —SH | —OH | H |
| g-14 | H | —SH | —$NH_2$ | H |
| g-15 | H | —SH | —OH | —$CH_3$ |
| g-16 | H | —SH | —$NH_2$ | —$C_2H_5$ |
| g-17 | H | .—SH | H | —$CH_3$ |
| g-18 | H | —SH | H | —OH |
| g-19 | H | —SH | H | —COOH |
| g-20 | H | —SH | H | —$SO_3H$ |
| g-21 | H | H | —SH | H |
| g-22 | —OH | H | —SH | H |
| g-23 | —OH | —$CH_3$ | —SH | H |
| g-24 | —$NH_2$ | H | —SH | H |
| g-25 | —SH | H | —SH | H |
| g-26 | H | H | H | —SH |
| g-27 | H | —OH | H | —SH |
| g-28 | —OH | H | H | —SH |
| g-29 | —$NH_2$ | H | H | —SH |
| g-30 | H | —$NH_2$ | H | —SH |
| g-31 | H | —$NH_2$ | —$CH_3$ | —SH |
| g-32 | —SH | H | H | —SH |
| g-33 | —SH | —$CH_3$ | H | —SH |

-continued

| | $R_{31}$ | $R_{32}$ | $R_{33}$ | $R_{34}$ |
|---|---|---|---|---|
| g-34 | H | —$OCH_3$ | H | —SH |
| g-35 | —SH | —SH | H | —SH |
| g-36 | H | —$CH_3$ | —$CH_3$ | —SH |
| Exemplified compounds represented by Formula (h) | | | | |
| h-1 | H | H | —$NH_2$ | —SH |
| h-2 | H | —$CH_3$ | —$NH_2$ | —SH |
| h-3 | H | H | —SH | —SH |
| h-4 | —OH | H | —SH | —SH |
| h-5 | H | H | —COOH | —SH |
| h-6 | H | H | H | —SH |
| h-7 | —OH | H | H | —SH |
| h-8 | H | —OH | H | —SH |
| h-9 | —$CH_3$ | —OH | H | —SH |
| h-10 | —$NH_2$ | H | H | —SH |
| h-11 | —OH | H | —SH | H |
| h-12 | —$NH_2$ | H | —SH | H |
| h-13 | —OH | —$CH_3$ | —SH | H |
| h-14 | —$NH_2$ | —$C_2H_5$ | —SH | H |
| h-15 | H | —$CH_3$ | —SH | H |
| h-16 | H | —OH | —SH | H |
| h-17 | H | H | —SH | H |
| h-18 | —OH | H | —SH | —$CH_3$ |
| h-19 | —OH | —$CH_3$ | —SH | H |
| h-20 | —$NH_2$ | H | —SH | H |
| h-21 | —SH | H | —SH | H |
| h-22 | H | —SH | H | —OH |
| h-23 | H | —SH | —OH | —$NH_2$ |
| h-24 | H | —SH | —$NH_2$ | H |
| h-25 | H | —SH | —COOH | H |
| h-26 | H | —SH | H | H |
| h-27 | —$OCH_3$ | —SH | H | H |
| h-28 | H | —SH | H | —$SO_3H$ |
| h-29 | —SH | H | H | H |
| h-30 | —SH | —OH | H | H |
| h-31 | —SH | H | H | —$NH_2$ |
| h-32 | —SH | —$CH_3$ | H | H |

The content of compounds represented by Formula (1) in the backing layer is preferably 7–150 mg/$m^2$. The content is more preferably 5–200 mg/$m^2$, most preferably 10–100 mg/$m^2$, in view of conditions such as reduction of dissolved silver and photographic properties.

The backing layer herein refers to a layer provided on the support opposite a silver halide emulsion layer and contains a binder such as a hydrophilic binder. The thickness of the backing layer is 2 to 7 μm, and preferably 3 to 5 μm. When the backing layer consists of two or more layers, the compounds represented by Formula (1) is preferably added to an uppermost layer or a layer adjacent to the uppermost layer.

In the invention when the replenishing amount of developer replenisher is not more than 200 ml/$m^2$, it is possible to reduce a dissolving silver amount more than that in the conventional method. Even when the replenishing amount of developer replenisher is not more than 160 ml/$m^2$ or mot more than 100 ml/$m^2$, it is possible to keep a dissolving silver amount to a lesser extent. As a result, the reduction of the replenishing amount of developer replenisher brings about prevention of silver sludge occurrence.

In view of the above, the replenishing amount of developer replenisher of the invention is preferably 50 to 160 ml/$m^2$, and more preferably 70 to 120 ml/$m^2$.

In the invention the developer replenisher may be the same as or different from developer used, and preferably the same as developer used.

The photographic light-sensitive material used in the invention preferably contain a contrast increasing agent such as a hydrazine derivative or a tetrazolium compound.

Particularly in the light-sensitive material used in the invention contain a hydrazine derivative or a tetrazolium compound dot quality is greatly improved or occurrence of black spots is reduced by addition of the compound represented by Formula (1) to the backing layer.

Next, the hydrazine derivative used in the invention is represented by the following Formula (2).

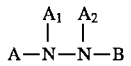

Formula (2)

Formula (2) will be detailed below.

In Formula (2) A represents an aliphatic group, an aryl group or a heterocyclic group.

The aliphatic group represented by A is preferably a group having 1 to 30 carbon atoms, and more preferably a straight-chained, branched or cyclic alkyl group having 1 to 20 carbon atoms. The examples thereof include a methyl, ethyl, t-butyl, octyl, cyclohexyl and benzyl group, each of which may have a substituent such as an aryl, alkoxy, aryloxy, alkylthio, arylthio, sulfoxy, sulfonamide, acylamino, or ureido group.

The aryl group represented by A is preferably a single or condensed ring group, for example, a benzene ring or a naphthalene ring.

The heterocyclic group represented by A is preferably a single or condensed ring group containing a hetercycle having one hetero atom selected from a nitrogen, sulfur and oxygen atom, such as a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring or a furan ring.

A especially preferably represents an aryl group or a heterocyclic group. The aryl or heterocyclic group of A may have a substituent. The examples of the substituent include an alkyl group (preferably having 1 to 20 carbon atoms), an aralkyl group (preferably a single or condensed ring group having an alkyl group of 1 to 3 carbon atoms), an alkoxy group (preferably having an alkyl group of 1 to 20 carbon atoms), a substituted amino group (preferably having an alkyl group or alkylidene group of 1 to 20 carbon atoms), an acylamino group (preferably having 1 to 40 carbon atoms), a sulfonamide group (preferably having 1 to 40 carbon atoms), a ureido group (preferably having 1 to 40 carbon atoms), a hydrazinocarbonylamino group (preferably having 1 to 40 carbon atoms), a hydroxy group or a phosphoamide group (preferably having 1 to 40 carbon atoms).

The group represented by A preferably has at least one of a non-diffusible group and a group for promoting silver halide adsorption. The non-diffusible group is preferably a ballast group which is conventionally used in immobile photographic additives such as couplers, and the ballast group includes an alkyl, alkenyl, alkinyl or alkoxy group having not less than 8 carbon atoms or a phenyl, phenoxy or alkylphenoxy group, which is relatively inactive to photographic properties.

The group for promoting silver halide adsorption includes a thiourea, thiourethane, mercapto, thioether, thion, heterocyclic, thioamidoheterocyclic or mercaptoheterocyclic group or an adsorption group described in Japanese Patent O.P.I. Publication No. 64-90439/1989.

The example of B includes an acyl group (for example, formyl, acetyl, propionyl, trifluoroacetyl, methoxyacetyl, phenoxyacetyl, methylthioacetyl, chloroacetyl, benzoyl, 2-hydroxymethylbenzoyl, 4-chlorobenzoyl), an alkylsulfonyl group (for example, methanesulfonyl, chloroethanesulfonyl), an arylsulfonyl group (for example, benzenesulfonyl), an alkylsulfinyl group (for example, methanesulfinyl), an arylsulfinyl group (for example, benzenesulfinyl), a carbamoyl group (for example, methylcarbamoyl, phenylcarbamoyl), an alkoxycarbonyl group (for example, methoxycarbonyl, methoxyethoxycarbonyl), an aryloxycarbonyl group (for example, phenyloxycarbonyl), a sulfamoyl group (for example, dimethylsulfamoyl), a sulfinamoyl group (for example, methylsulfinamoyl), an alkoxysulfonyl group (for example, methoxysulfonyl), a thioacyl group (for example, methylthiocarbonyl), a thiocarbamoyl group (for example, methylthiocarbamoyl), an oxalyl group or a heterocyclic group (for example, pyridinyl, pyridinium).

B in Formula (2) may form —N=C($R_9$)($R_{10}$) together with $A_2$ and a nitrogen atom, wherein $R_9$ represents an alkyl group, an aryl group or a heterocyclic group, and $R_{10}$ represents a hydrogen atom, an alkyl group, an aryl group or a heterocyclic group.

B is especially preferably an acyl group or an oxalyl group.

$A_1$ and $A_2$ represent both hydrogen atoms or one of $A_1$ and $A_2$ represents a hydrogen atom and the other represents an acyl group (acetyl, trifluoroacetyl, benzoyl), a sulfonyl group (methanesulfonyl, toluenesulfonyl) or an oxalyl group (ethoxalyl).

Of the hydrazine compounds in the invention, the compound represented by the following Formula (3) is especially preferable:

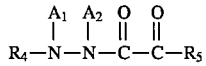

Formula (3)

wherein $R_4$ represents an aryl group or a heterocyclic group, $R_5$ represents

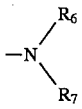

group or —$OR_8$ group wherein $R_6$ and $R_7$ independently represent a hydrogen atom, an alkyl group, an alkenyl group, an alkinyl group, an aryl group, a heterocyclic group, an amino group, a hydroxy group, an alkoxy group, an alkenyloxy group, an alkinyloxy group, an aryloxy group or a heterocyclicoxy group, provided that $R_6$ and $R_7$ may form a ring together with a nitrogen atom, $R_8$ represents a hydrogen atom, an alkyl group, an alkenyl group, an alkinyl group, an aryl group or a heterocyclic group, and $A_1$ and $A_2$ are the same as $A_1$ and $A_2$ of Formula (2), respectively.

The Formula (3) will be described in detail below.

The aryl group represented by $R_4$ is preferably a single or condensed ring group, for example, a benzene ring group or a naphthalene ring group.

The heterocyclic group represented by $R_4$ is preferably a single or condensed ring group containing a 5- or 6-membered heterocycle having one hetero atom selected from a nitrogen, sulfur and oxygen atom, such as a pyridine ring, a quinoline ring, a pyrimidine ring, a thiophene ring, a furan ring, a thiazole ring or a benzothiazole ring.

$R_4$ is preferably a substituted or unsubstituted aryl group. The substituent is the same as that of A in Formula (2). $R_4$ is preferably a group having at least one sulfo group when a developer having pH of not more than 11.2 is used for high contrast.

$A_1$ and $A_2$ are the same as $A_1$ and $A_2$ of Formula (2), respectively, and are most preferably simultaneously hydrogen atoms.

$R_6$ and $R_7$ independently represent a hydrogen atom, an alkyl group (methyl, ethyl or benzyl), an alkenyl group (allyl, butenyl), an alkinyl group (propagyl, butinyl), an aryl group phenyl, naphthyl), a heterocyclic group (2,2,6,6-tetramethylpiperidinyl, N-benzylpiperidinyl, quinolidinyl, N,N'-diethylpyrazolidinyl, N-benzylpyrrolidinyl, pyridyl), an amino group (amino, methylamino, dimethylamino, dibenzylamino), a hydroxy group, an alkoxy group (methoxy, ethoxy), an alkenyloxy group (allyloxy), an alkinyloxy group (propagyloxy), an aryloxy group (phenoxy) or a heterocyclic group (pyridyl), provided that $R_6$ and $R_7$ may combine each other with a nitrogen atom to form a ring (piperidine, morpholine), and $R_8$ represents a hydrogen atom, an alkyl group (methyl, ethyl, methoxyethyl or hydroxyethyl), an alkenyl group (allyl, butenyl), an alkinyl group (propagyl, butinyl), an aryl group phenyl, naphthyl), or a heterocyclic group (2,2,6,6-tetramethylpiperidinyl, N-methylpiperidinyl, pyridyl).

The Exemplified compounds represented by Formula (2) will be shown below, but the invention is not limited thereto.

[3-1]

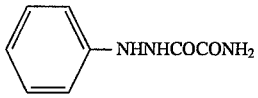

[3-2]

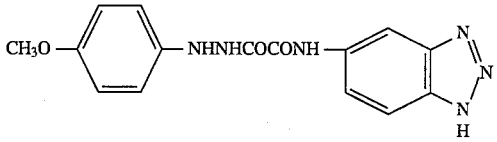

[3-3]

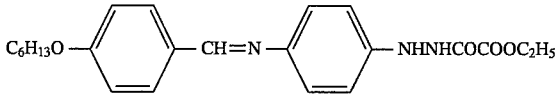

[3-4]

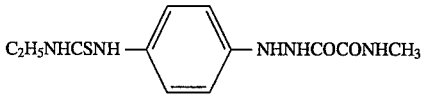

[3-5]

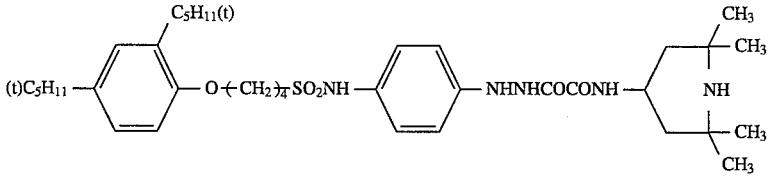

[3-6]

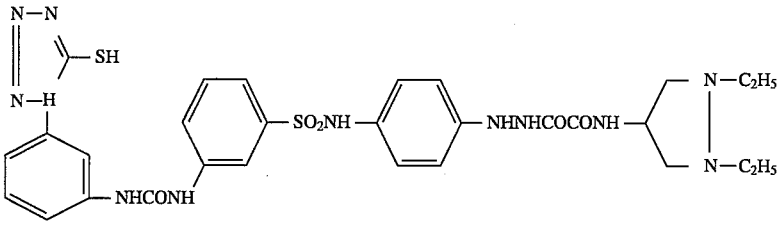

[3-7]

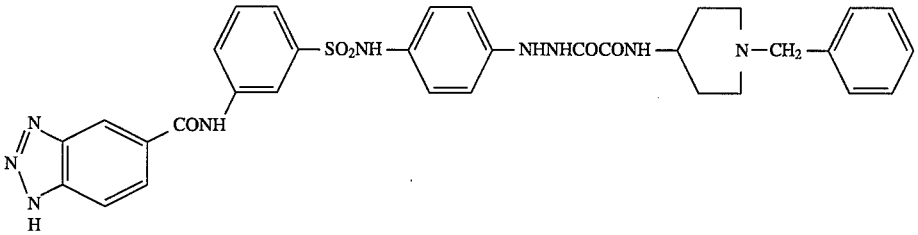

[3-8]

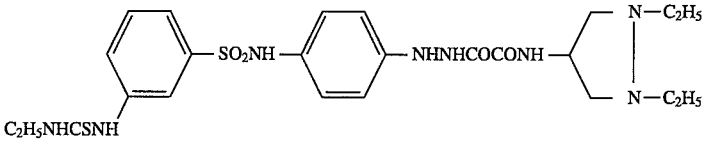

-continued
[3-9]
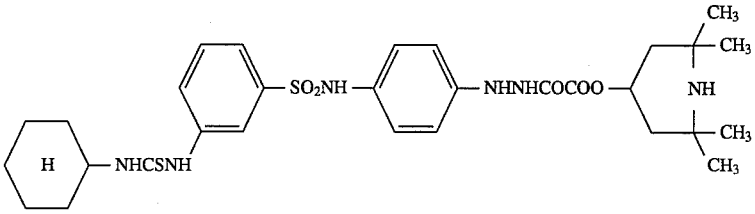
[3-10]
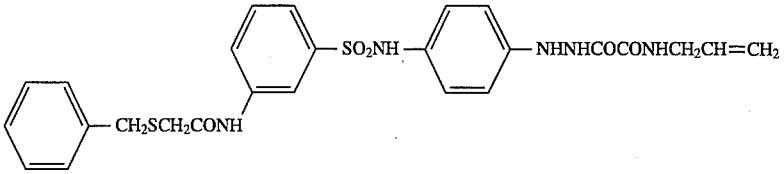
[3-11]
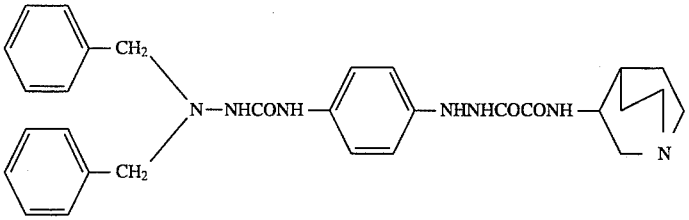
[3-12]
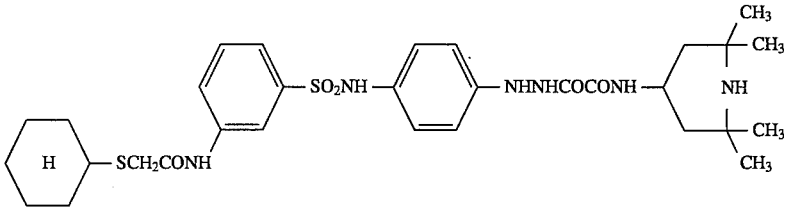
[3-13]
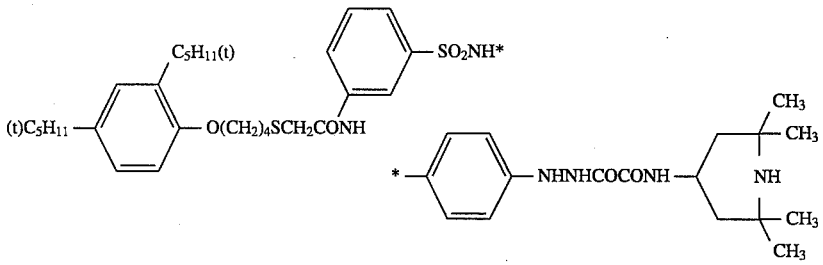
[3-14]
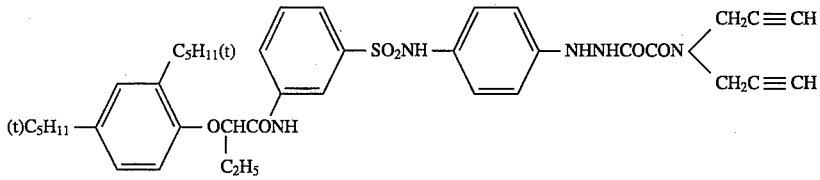
[3-15]
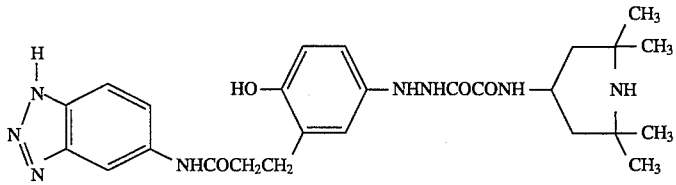
[3-16]
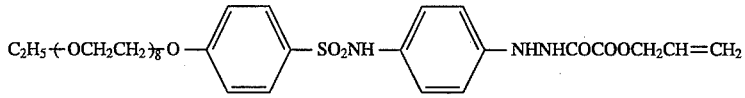

-continued
[3-17]
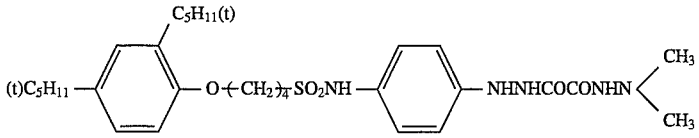
[3-18]
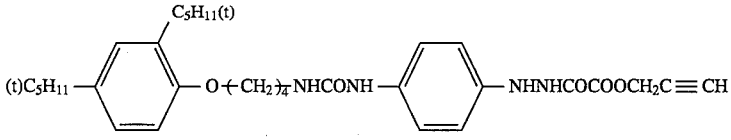
[3-19]
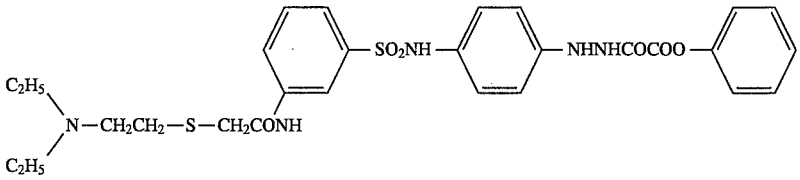
[3-20]
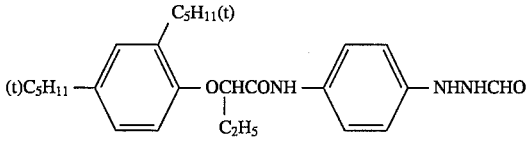
[3-21]
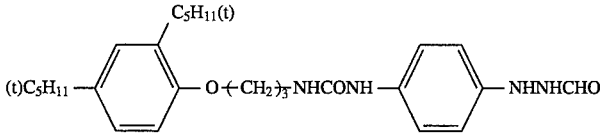
[3-22]
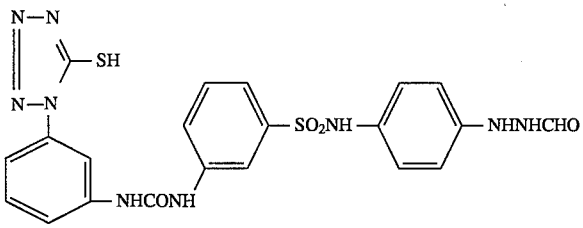
[3-23]
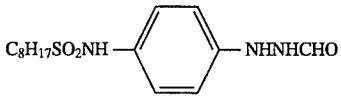
[3-24]
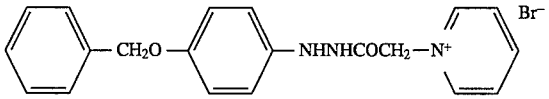
[3-25]
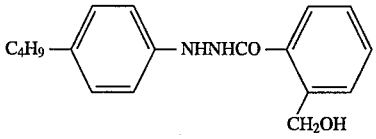
[3-26]
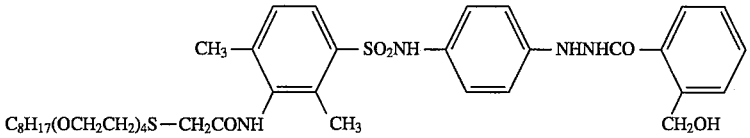
[3-27]
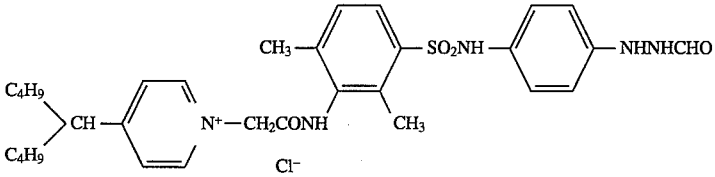

-continued
[3-28]
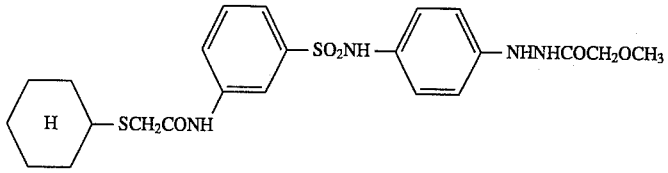
[3-29]
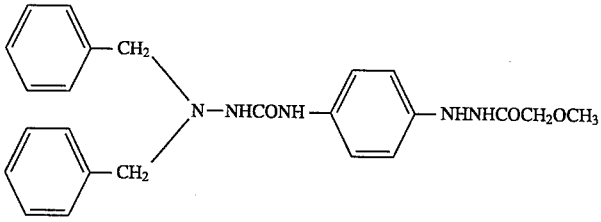
[3-30]
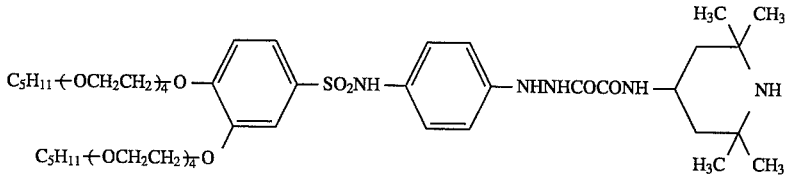
[3-31]
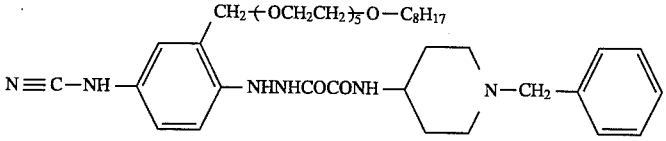
[3-32]
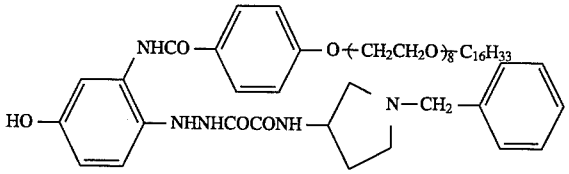
[3-33]
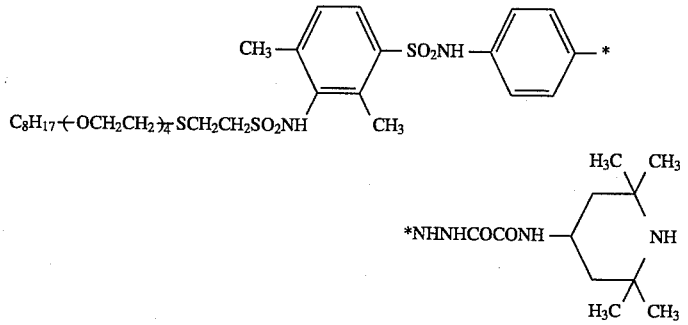
[3-34]
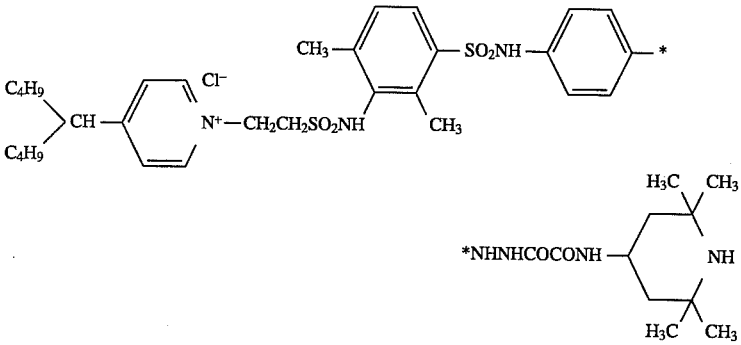

-continued
[3-35]
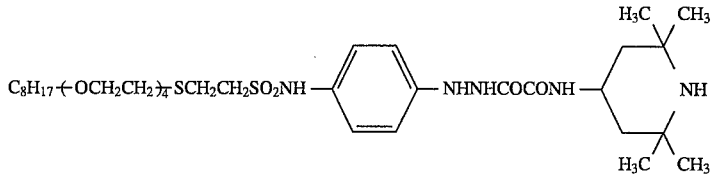
[3-36]
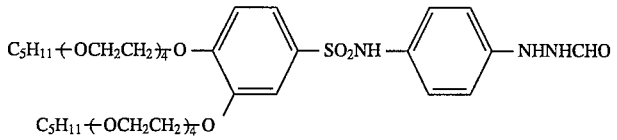
[3-37]
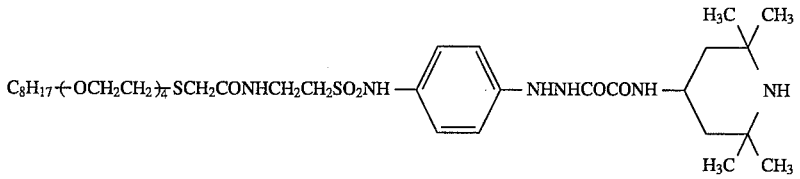
[3-38]
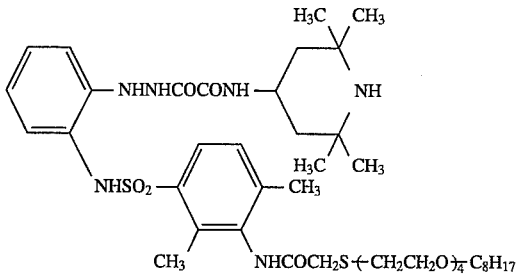
[3-39]
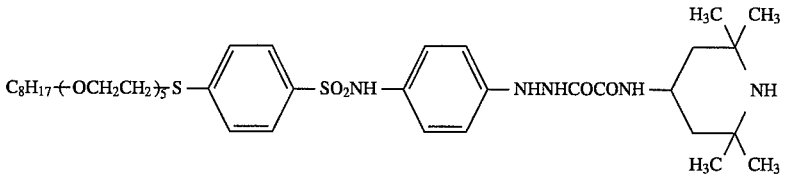
[3-40]
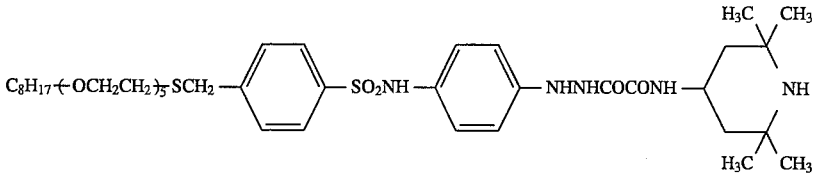
[3-41]
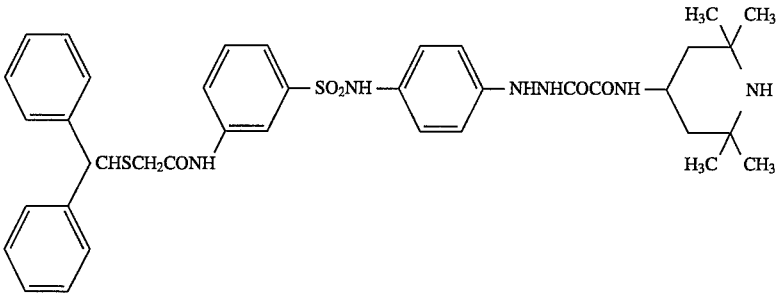
[3-42]
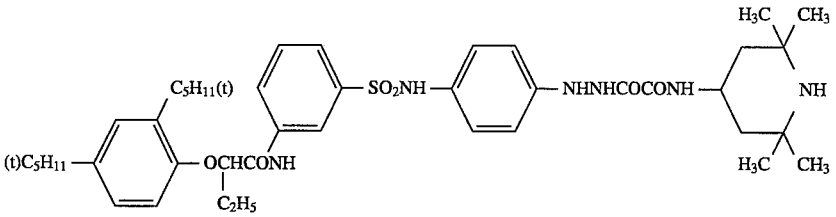

-continued

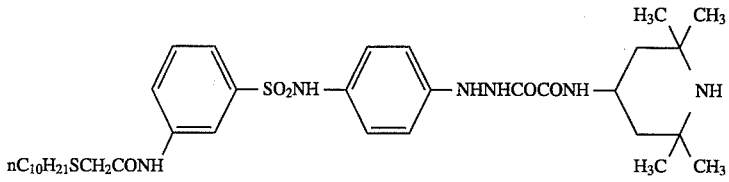

[3-43]

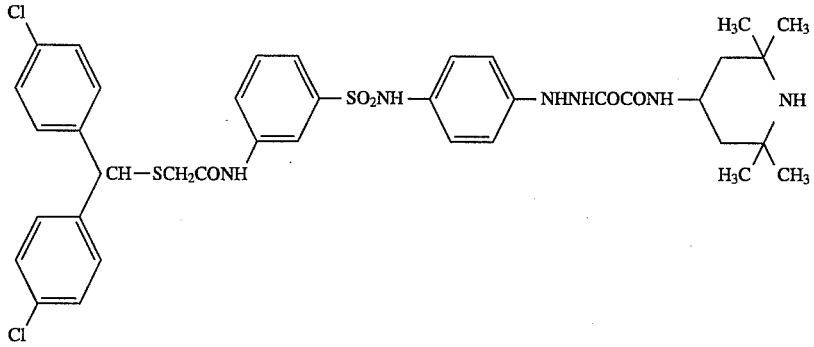

[3-44]

The synthetic method of a compound represented by Formula (2) is referred to in Japanese Patent O.P.I. Publication Nos. 62-180361, 62-178246, 63-234245, 63-234246, 64-90439, 2-37, 2-841, 2-947, 2-120736, 2-230233 and 3-125134, U.S. Pat. Nos. 4,686,167, 4,988,604 and 4,994,365, European Patent Nos. 253,665 and 333,435.

The content of the compound of the invention represented by Formula (2) is preferably $5\times10^{-7}$ to $5\times10^{-1}$ mol/mol of silver, and more preferably $5\times10^{-6}$ to $5\times10^{-2}$ mol/mol of silver.

In the invention the compound represented by Formula (2) is contained in the silver halide emulsion layer or its adjacent hydrophilic colloid layers of a photographic light sensitive material.

The nuclear promoting agent used in the invention includes a compound represented by the following Formula (4) or (5):

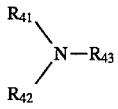

Formula (4)

-continued

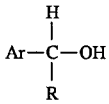

Formula (5)

In Formula (4) $R_{41}$, $R_{42}$ and $R_{43}$ independently represent a hydrogen atom, an alkyl group, a substituted alkyl group, an alkenyl group, a substituted alkenyl group, an alkinyl group, an aryl group or a substituted aryl group, provided that $R_{41}$, $R_{42}$ and $R_{43}$ may form a ring together and $R_{41}$, $R_{42}$ and $R_{43}$ is not simultaneously hydrogen atoms. The preferable agent is an aliphatic tertiary amines. These compounds preferably have in the molecules an anti-diffusible group or a silver halide adsorption group. The compounds having anti-diffusible property have preferably a molecular weight not less than 100, and more preferably a molecular weight not less than 300. The preferable adsorption group includes a heterocyclic, mercapto, thioether, thion or thiourea group.

The examples thereof will be shown below.

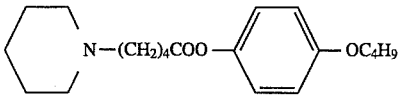

[4-1]

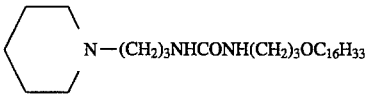

[4-2]

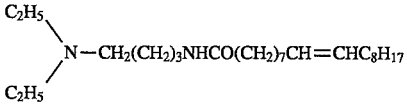

[4-3]

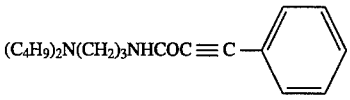

[4-4]

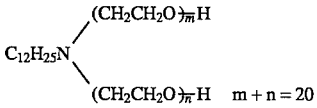

[4-5]

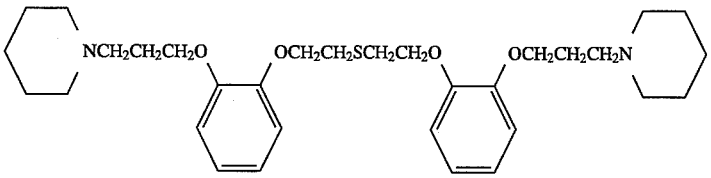

[4-6]

-continued

[4-7]

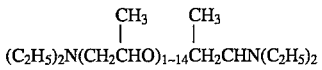

[4-8]

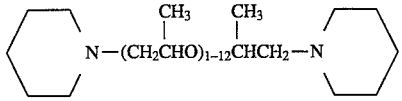

[4-9]

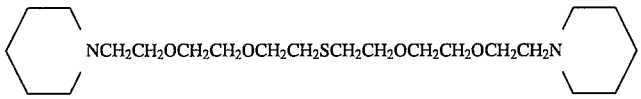

[4-10]

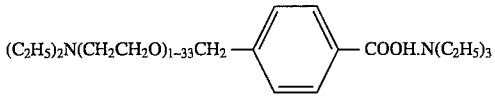

[4-11]

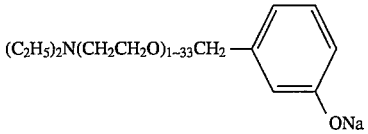

[4-12]

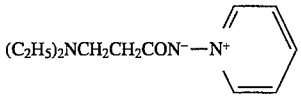

[4-13]

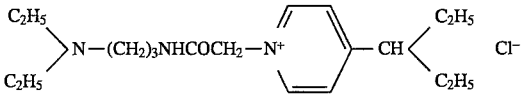

[4-14]

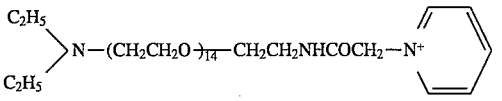

[4-15]

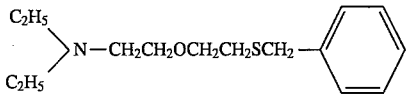

[4-16]

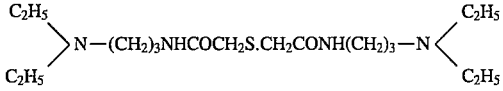

[4-17]

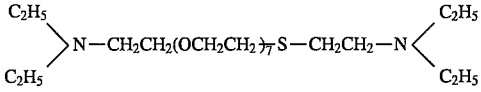

[4-18]

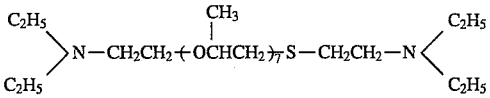

[4-19]

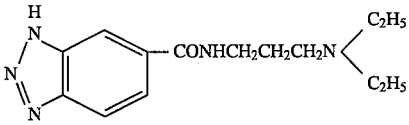

[4-20]

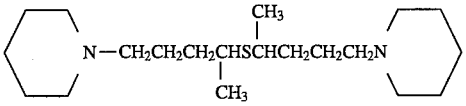

[4-21]

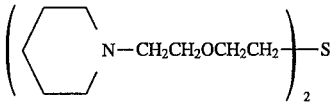

[4-22]

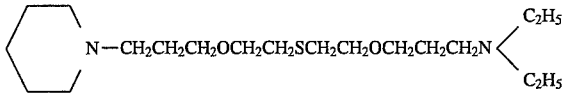

In Formula (5) Ar represents a substituted or unsubstituted aryl or aromatic heterocyclic group; and R represents an alkyl group, an alkenyl group, an alkinyl group or an aryl group, each of which may have a substituent. These compounds preferably have in the molecules an anti-diffusible group or a silver halide adsorption group. The compounds having anti-diffusible property have preferably a molecular weight not less than 120, and more preferably a molecular weight not less than 300.

The examples thereof will be shown below.

[5-1]

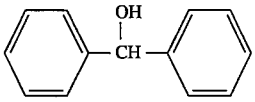

[5-2]

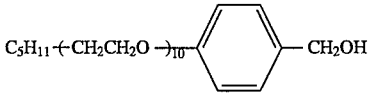

[5-3]

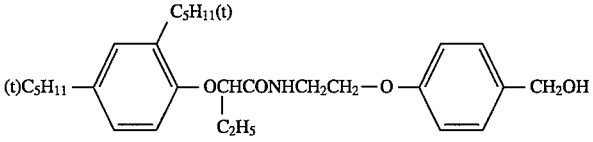

[5-4]

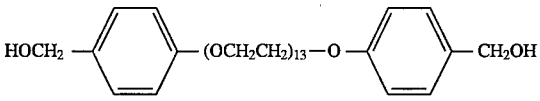

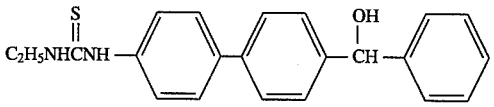

-continued

[5-5]

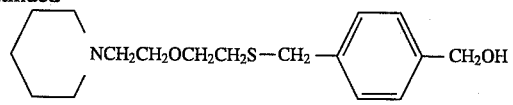

[5-6]

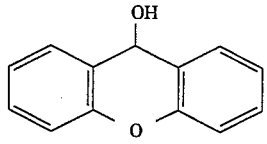

[5-7]

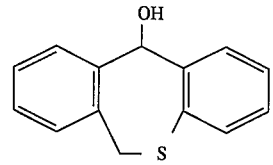

[5-8]

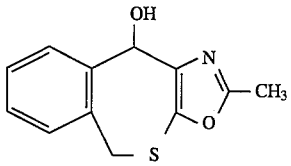

[5-9]

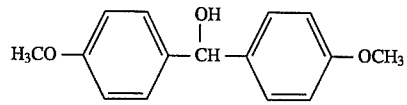

[5-10]

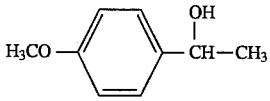

[5-11]

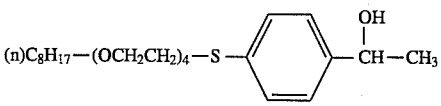

[5-12]

The nuclear promoting agent may be contained in the emulsion layer of the invention or a layer adjacent thereto.

The above tetrazolium compounds used in the light sensitive material of the invention is represented by the following Formula (6):

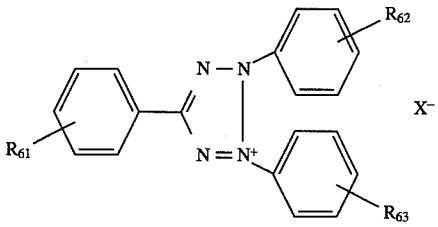

Formula (6)

wherein $R_{61}$, $R_{62}$ and $R_{63}$ represent each a hydrogen atom or a substituent; and $X^-$ represents anion.

Now, the tetrazolium compound having the above Formula (6), that is applicable to the invention, will be detailed. In the above Formula (6), the preferable examples of the substituents represented by $R_1$ through $R_3$ include an alkyl group (such as those of methyl, ethyl, cyclopropyl, propyl, isopropyl, cyclobutyl, butyl, isobutyl, pentyl and cyclohexyl), an amino group, an acylamino group (such as those of acetylamino), a hydroxyl group, an alkoxy group (such as those of methoxy, ethoxy, propoxy, butoxy and pentoxy), an acyloxy group (such as those of acetyloxy), a halogen atom (such as those of fluorine, chlorine and bromine), a carbamoyl group, an acylthio group (such as those of acetylthio), an alkoxycarbonyl group (such as those of ethoxycarbonyl), a carboxyl group, an acyl group (such as those of acetyl), a cyano group, a nitro group, a mercapto group, a sulfoxy group and an aminosulfoxy group.

The anion represented by the above-denoted $X(^-)$ includes, for example, a halogen ion such as a chloride ion, a bromide ion and an iodide ion, an acid residue of an inorganic acid such as nitric acid, sulfuric acid and perchloric acid, an acid residue of an organic acid such as sulfonic acid and carboxylic acid, an anionic type activator typically including a lower alkyl benzene sulfonic acid anion such as p-toluene sulfonic acid anion, a higher alkyl benzene sulfonic acid anion such as p-dodecyl benzene sulfonic acid anion, a higher alkyl sulfate anion such as lauryl sulfate anion, a boric acid type anion such as tetraphenyl boron, dialkyl sulfosuccinate anion such as di-2-ethylhexyl succinate anion, a polyether alcohol sulfate anion such as cetyl polyetheroxy sulfate anion, a higher aliphatic anion such as stearic acid anion, and a polymer attached with an acid radical such as polyacrylic acid anion.

Some concrete examples of the compounds of the invention represented by Formula (6) will be given below. However, the compounds of the invention shall not be limited thereto.

| Compound No. | $R_{61}$ | $R_{62}$ | $R_{63}$ | $X^-$ |
|---|---|---|---|---|
| 6-1 | H | H | H | $Cl^-$ |
| 6-2 | H | p-$CH_3$ | p-$CH_3$ | $Cl^-$ |
| 6-3 | H | m-$CH_3$ | m-$CH_3$ | $Cl^-$ |
| 6-4 | H | o-$CH_3$ | o-$CH_3$ | $Cl^-$ |
| 6-5 | p-$CH_3$ | p-$CH_3$ | p-$CH_3$ | $Cl^-$ |
| 6-6 | H | p-$OCH_3$ | p-$OCH_3$ | $Cl^-$ |
| 6-7 | H | m-$OCH_3$ | m-$OCH_3$ | $Cl^-$ |
| 6-8 | H | o-$OCH_3$ | o-$OCH_3$ | $Cl^-$ |
| 6-9 | p-$OCH_3$ | p-$OCH_3$ | p-$OCH_3$ | $Cl^-$ |
| 6-10 | H | p-$C_2H_5$ | p-$C_2H_5$ | $Cl^-$ |
| 6-11 | H | m-$C_2H_5$ | m-$C_2H_5$ | $Cl^-$ |
| 6-12 | H | p-$C_3H_7$ | p-$C_3H_7$ | $Cl^-$ |
| 6-13 | H | p-$OC_2H_5$ | p-$OC_2H_5$ | $Cl^-$ |
| 6-14 | H | p-$OCH_3$ | p-$OCH_3$ | $Cl^-$ |
| 6-15 | H | p-$OCH_3$ | p-$OC_2H_5$ | $Cl^-$ |
| 6-16 | H | p-$OC_5H_{11}$ | p-$OCH_3$ | $Cl^-$ |
| 6-17 | H | p-$OC_8H_{17}$-n | p-$OC_8H_{17}$-n | $Cl^-$ |
| 6-18 | H | p-$C_{12}H_{25}$-n | p-$C_{12}H_{25}$-n | $Cl^-$ |
| 6-19 | H | p-$N(CH_3)_2$ | p-$N(CH_3)_2$ | $Cl^-$ |
| 6-20 | H | p-$NH_2$ | p-$NH_2$ | $Cl^-$ |
| 6-21 | H | p-OH | p-OH | $Cl^-$ |
| 6-22 | H | m-OH | m-OH | $Cl^-$ |
| 6-23 | H | p-Cl | p-Cl | $Cl^-$ |
| 6-24 | H | m-Cl | m-Cl | $Cl^-$ |
| 6-25 | p-CN | p-$CH_3$ | p-$CH_3$ | $Cl^-$ |
| 6-26 | p-SH | p-$OCH_3$ | p-$OCH_3$ | $Cl^-$ |
| 6-27 | H | p-$OCH_3$ | p-$OCH_3$ | 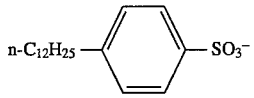 |

The tetrazolium compounds used in the invention can be easily prepared by methods described on Chemical Reviews 55, pages 335–483.

The content of the tetrazolium compound of Formula (6) is 1 mg to 10 g, and preferably 10 mg to 2 g per mole of silver halide contained in the light sensitive material of the invention.

The tetrazolium compounds used in the invention can be used singly or in combination in an appropriate proportion of two or more kinds.

The conventional developer can be used in the invention.

The developing agent used in the invention include dihydroxy benzenes (for example, hydroquinone, chlorohydroquinone, bromohydroquinone, 2,3-dichlorohydroquinone, methylhydroquinone, isopropylhydroquinone or 2,5-dimethylhydroquinone), 3-pyrazolidone (for example, 1-phenyl-3-pyrazolidone, 1-phenyl-4-methyl-3-pyrazolidone, 1-phenyl-4,4'-dimethyl-3-pyrazolidone, 1-phenyl-4-ethyl-3-pyrazolidone or 1-phenyl-5-methyl-3-pyrazolidone), aminophenols (for example, o-aminophenol, p-aminophenol, N-methyl-p-aminophenol or 2,4-diaminophenol), pyrogallol, ascorbic acid, 1-aryl-3-pyrazolines (for example, 1-(p-hydroxyphenyl)-3-aminopyrazoline, 1-(p-methylaminophenyl)-3-aminopyrazoline, or 1-(p-amino-n-methylphenyl)-3-aminopyrazoline. They may be used singly or in combination. The combination of 3-pyrazolidones with dihydroxy benzenes or the combination of aminophenols with dihydroxy benzenes is preferable. The amount used of the developing agent is 0.01 to 1.4 mol per liter of developer.

The sulfites or metabisulfites as preservatives include sodium sulfite, potassium sulfite, ammonium sulfite and sodium metabisulfite. The amount used of the sulfite is not less than 0.25 mol per liter, and preferably not less than 0.4 mol per liter of developer.

Besides the above compounds, the developer optionally contains alkali agents (sodium hydroxide or potassium hydroxide), pH buffering agents (for example, carbonates, phosphates, borates, boric acid, acetic acid, citric acid or alkanol amines), auxiliary solubility agents (for example, polyethylene glycols or salts thereof or alkanol amines), sensitizing agents (for example, non-ionic surfactant including polyoxy ethylenes or quaternary ammonium salts), surfactants, anti-foggants (for example, halides such as potassium bromide and sodium bromide, nitro benzindazole, nitro benzimidazole, benzotriazoles, benzothiazoles, tetrazoles or thiazoles), chelating agents (for example, ethylenediaminetetraacetic acid or an alkali metal salt thereof, nitrilotriacetic acid salts or polyphosphoric acid salts), hardeners (for example, glutaraldehyde or an bisulfite adduct thereof) or anti-foaming agents. The pH of the developer is preferably adjusted to be 9.5 to 12.0.

The conventional fixer can be used in the invention.

The fixer is usually an aqueous solution comprised of a fixing agent and other additives, and has a pH of 3.8 to 5.8. As the fixing agent, thiosulfates such as sodium thiosulfate, potassium thiosulfate or ammonium thiosulfate, thiocyanates such as sodium thiocyanate, potassium thiocyanate or ammonium thiocyanate, or organic sulfur compounds capable of producing soluble stable silver complexes can be used.

To the fixer can be added water soluble aluminum salts acting as a hardener such as aluminium chloride, aluminium sulfate and potash alum. To the fixer can be optionally added preservatives such as sulfites or metabisulfites, pH buffering agents (for example, acetic acid), pH regulators (for example, sulfuric acid) or chelating agents capable of softening hard water.

The light-sensitive material in the invention shows excellent properties in a rapid processing using an automatic developing apparatus wherein the total processing time is 15 to 60 seconds. In the rapid processing method in the invention the developing and fixing temperatures are independently about 25° C. to 50° C., and preferably 30° C. to 40° C., and the developing and fixing times are independently not more than 25 seconds, and preferably 4 to 15 seconds. In the invention the total processing time is a total time taken from the entry of the leading edge of a film in the apparatus to the delivery of the leading edge out of the drying zone of the apparatus. The film is conveyed through the developing tank, the cross-over, the fixing tank, the cross-over, the washing tank, the cross-over and the drying zone in the automatic developing apparatus.

EXAMPLES

The Examples of the present invention will be detailed below, but not limited thereto.

Example 1

Preparation of light sensitive material 1 (containing a tetrazolium compound)

(Synthesis of Latex Lx-1)

To a mixture of 40 liter water, 1.25 kg gelatin and 0.05 kg ammonium persulfate were added 7.5 g of sodium dodecylbenzenesulfonate. A mixture of the following monomers was added to the resulting solution at 50° C. under nitrogen atmosphere while stirring at such an adding speed that a polymer having an average particle size of 0.1 μm was obtained and stirred for 3 hours. Thereafter, 0.05 kg of ammonium persulfate was added thereto and stirred for additional 1.5 hours. After completion of reaction, the resulting mixture was steam-distilled for one hour to remove remaining monomers, cooled to room temperature and adjusted to pH 6.0 using an aqueous ammonia. Water was added to the mixture to make 80.5 kg.

| | |
|---|---|
| (a) Ethyl acrylate | 5.0 kg |
| (b) Methylmethacrylate | 1.4 kg 35° C. |
| (c) Styrene | 3.0 kg |
| (d) Acrylamide-2-methylpropane sulfonic acid sodium salt | 0.6 g |

(Synthesis of Latex Lx-2)

A mixture of the following monomers was added in one hour at 80° C. under nitrogen atmosphere while stirring to a mixture of 40 liter water, 0.25 kg of KMDS (surfuric acid dextrane ester sodium salt produced by Meito Sangyo Co., Ltd.) and 0.05 kg ammonium persulfate and stirred for additional 1.5 hours. After completion of reaction, the resulting mixture was steam-distilled for one hour to remove remaining monomers, cooled to room temperature and adjusted to pH 6.0 using an aqueous ammonia. Water was added to the mixture to make 50.5 kg of latex.

| | |
|---|---|
| (a) n-Butyl acrylate | 4.51 kg |
| (b) Styrene | 5.49 kg |
| (c) Acrylic acid | 0.1 kg |

(Preparation of silver halide emulsion)

A silver nitrate solution and a sodium chloride and potassium bromide solution prepared to contain $8\times10^{-5}$ mol/mol of silver of a rhodium hexachloride complex salt were added to a gelatin solution in a double-jet precipitation method, controlling the adding speed. The resulting solution was desalted and a monodisperse, cubic silver bromochloride emulsion having a silver bromide content of 1 mol % and a particle diameter of 0.13 μm was obtained.

(Preparation of a silver halide photographic light-sensitive material)

The resulting emulsion was sulfur-sensitized with the conventional method and added with 6-methyl-4-hydroxy-1,3,3a,7-tetrazaindene as a stabilizing agent. Then, a silver halide emulsion coating solution of the following Prescription was prepared. A silver halide emulsion protective layer coating solution of the following Prescription 2, a backing layer coating solution of the following Prescription 3 and a bacing protective layer coating solution of the following Prescription 4 were prepared. The compositions will be shown below.

Prescription 1 (a silver halide emulsion layer composition)

| | |
|---|---|
| Compound (a) | 1 mg/m$^2$ |
| NaOH (0.5N) an amount necessary to adjust to pH 5.6 | |
| Compound (b) Tetrazolium compound Exemplified compound 6-6 | 40 mg/m$^2$ |
| Saponin (20% aqueous solution) | 0.5 ml/m$^2$ |
| Sodium dodecylbenzenesulfonate | 20 mg/m$^2$ |
| 5-Methylbenzotriazole | 10 mg/m$^2$ |
| Compound (d) | 2 mg/m$^2$ |
| Compound (e) | 10 mg/m$^2$ |
| Compound (f) | 6 mg/m$^2$ |
| Latex Lx-1 | 0.5 g/m$^2$ |
| Styrene-maleic acid copolymer (thickner) | 90 mg/m$^2$ |

The chemical structures of the above compounds will be shown below.

A mixture of (a)

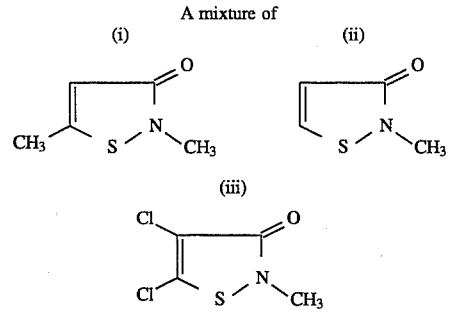

(i):(ii):(iii) = 50:46:4 (mole ratio)

(b)

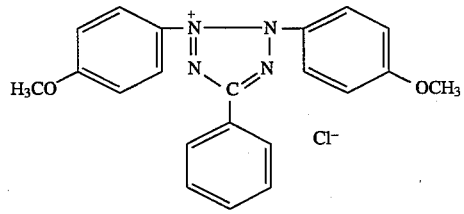

(d)

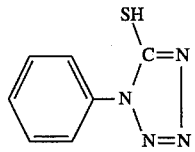

(e)

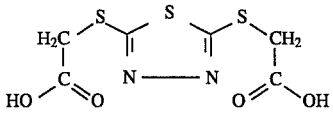

-continued (f)

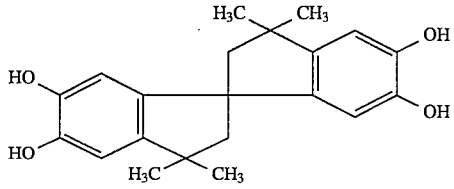

| Prescription 2 (a silver halide emulsion layer protective composition) | |
|---|---|
| Gelatin | 0.5 g/m² |
| Compound (g) (1% aqueous solution) | 25 ml/m² |
| Compound (h) | 120 mg/m² |
| Monodisperse spherical silica (8 μm) | 20 mg/m² |
| Monodisperse spherical silica (3 μm) | 10 mg/m² |
| Compound (i) | 100 mg/m² |
| Citric acid an amount necessary to adjust to pH 6.0 | |
| Latex Lx-2 | 0.5 g/m² |
| **Prescription 3 (a backing layer composition)** | |
| Gelatin | 1.0 g/m² |
| Compound (j) | 100 mg/m² |
| Compound (k) | 18 mg/m² |
| Compound (l) | 100 mg/m² |
| Saponin (20% aqueous solution) | 0.6 ml/m² |
| Latex (m) | 300 mg/m² |
| 5-Nitroindazole | 20 mg/m² |
| Styrene-maleic acid copolymer (thickner) | 45 mg/m² |
| Glyoxal | 4 mg/m² |
| Compound (o) | 100 mg/m² |
| Compound of Formula (1) | Shown in Table 1 |
| **Prescription 4 (a backing protective layer composition)** | |
| Gelatin | 0.5 g/m² |
| Compound (g) (1%) | 2 ml/m² |
| Spherical polymethylmethacrylate (4 μm) | 25 mg/m² |
| Sodium chloride | 70 mg/m² |
| Glyoxal | 22 mg/m² |
| Compound (n) | 100 mg/m² |

The chemical structures of the compounds used above will be shown below.

(g)

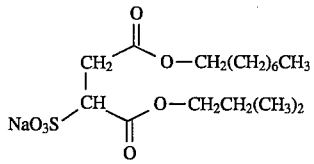

(h)

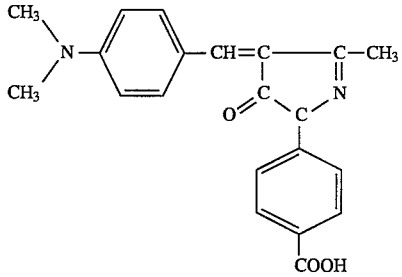

(dye to be dispersed in a solid form)

-continued (i)

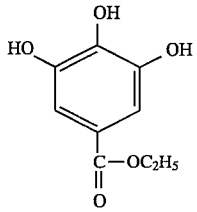

(j)

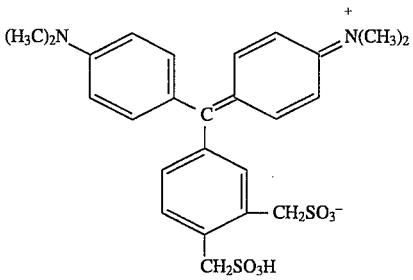

(k)

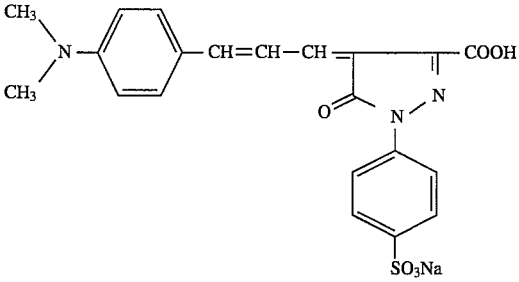

(l)

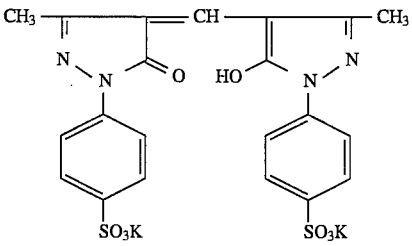

(m)

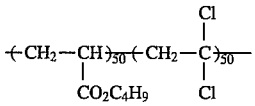

(n)

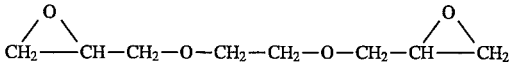

(o)

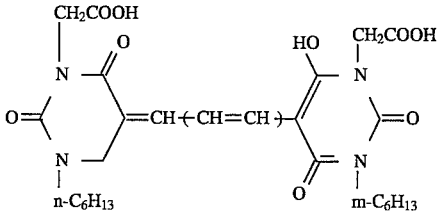

A polyethylene terephthalate support subbed on an emulsion side as shown in Japanese Patent O.P.I. Publication No. 59-19941 was corona-discharged in strength of 10(w/m2·min).

On the emulsion side of the support were simultaneously coated at 35° C. the emulsion layer of Prescription 1 and the emulsion protective layer of Prescription 2 in order according to a slide hopper method adding the above hardening solution and was set at a setting zone (5° C.). Thereafter, the resulting material was coated on the side opposite the emulsion side with the backing layer of Prescription 3 and the backing protective layer of Prescription 4 in order according to a slide hopper method and was set with a cold air. The material was sufficiently set through the setting zones and both surface of the material was further dried at a drying zone under the following drying conditions.

The transport before rolling after the backing layer side was coated was carried out using a roller and transport other than that was carried out without contact. The coating speed was 100 m/min.

(Drying condition)

The coated material after set was dried with a 30° C. air to have a $H_2O$/gelatin ratio of 800%, and then dried with a 30° C. and 30% RH air to have a $H_2O$/gelatin ratio of 200%. The resulting material was dried for 1 minute with a 48° C. and 2% RH air 30 seconds after the surface temperature reached 34° C. (judged as completion of drying). As regards the drying time, the time necessary to have a $H_2O$/gelatin ratio of 800% was 50 seconds, the time necessary to have a $H_2O$/gelatin ratio of 800–200% was 35 seconds, and the time from the $H_2O$/gelatin ratio of 800% till the completion of drying was 5 seconds.

The thus obtained light sensitive material was rolled, cut at 23° C. and 40% RH and tightly packaged with card board in a barrier package subjected for 3 hours to 23° C., 40% RH humidity conditioning. The barrier package was in advance subjected to humidity conditioning of 40° C. and 10% RH for 8 hours and further 23° C. and 30% RH for 2 hours. Samples were prepared in the same manner as above, except that compounds of Formula (1) shown in Table 1 were added in an amount as shown in Table 1. Thus, 25 samples were prepared.

The samples above obtained had a silver coating amount of 4.0 g/m$^2$ and a gelatin content of the emulsion layer of 2.0 g/m$^2$.

The gelatin content refers to the total gelatin content of the silver halide emulsion layer and the protective emulsion layer.

Preparation of light sensitive material 2 (containing a hydrazine compound)

(Preparation of silver halide emulsion A)

A silver bromoiodochloride emulsion containing 70 mol % of silver chloride, 0.2 mol % of silver iodide and silver bromide was prepared in a double-jet precipitation method. In the process $K_3RhBr_6$ was added in an amount of $8.1\times10^{-8}$ mol/mol of silver. The resulting emulsion was proved to be an emulsion comprising cubic monodisperse grains having an average particle diameter of 0.20 μm (with a variation coefficient of 9%). The emulsion was desalted with denatured gelatin disclosed in Japanese Patent O.P.I. Publication No. 2-280139 (one in which an amino group in gelatin is substituted with a phenylcarbamyl group, for example, Exemplified compound G-8 in Japanese Patent O.P.I. Publication No. 2-280139). The resulting EAg after the desalting was 190 mv at 50° C.

The resulting emulsion was adjusted to be pH 5.58 and EAg 123 mv, and the temperature thereof was elevated to 60° C. To the emulsion was added $2.2\times10^{-5}$ mol/mol of silver of chloroauric acid and the mixture was stirred for 2 minutes. To the mixture emulsion was added $2.9\times10^{-6}$ mol/mol of silver of $S_8$ and the mixture was chemically ripened for 78 minutes. After the ripening, 4-hydroxy-6-methyl-1,3,3a,7-tetrazaindene of $7.5\times10^{-3}$ mol per mol of silver, $3.5\times10^{-4}$ mol per mol of silver of 1-phenyl-5-mercaptotetrazole and 28.4 g per mol of silver of gelatin were added to the emulsion to obtain silver halide emulsion A.

(Preparation of silver halide photographic light-sensitive material)

In the same manner as in Example 1 a 100 μm thick polyethylene terephthalate film was coated on the subbing layer on one side with the silver halide emulsion of the following prescription 1 containing silver halide emulsion A to give a silver content of 3.3 g/m$^2$ and a gelatin content of 1.6 g/m$^2$. As a protective layer the composition of the following prescription 2 was coated on the emulsion layer to give a gelatin content of 1.0 g/m$^2$. The backing layer composition of the following prescription 3 was coated on the subbing layer on the other side to give a gelatin content of 2.7 g/m$^2$ and the backing protective layer composition of the following prescription 4 was coated on the backing layer to give a gelatin content of 1 g/m$^2$ and dried in the same manner as in Example 1. Samples were prepared in the same manner as above, except that compounds of Formula (1) shown in Table 2 were added in an amount as shown in Table 2. Thus, 25 samples were prepared.

Prescription 1 (silver halide emulsion layer composition)

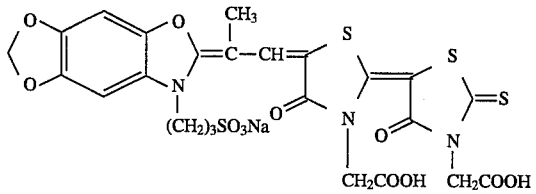

6.0 mg/m$^2$

-continued

| | |
|---|---|
| Hydrazine derivative<br>Exemplified compound (3-43) | $2 \times 10^{-4}$ mol/molAg |
| 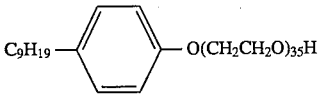 | 100 mg/m$^2$ |
| Nuclear promoting agent<br>Exemplified compound (4-21) | $1 \times 10^{-3}$ mol/molAg |
| Latex polymer | 0.5 g/m$^2$ |
| 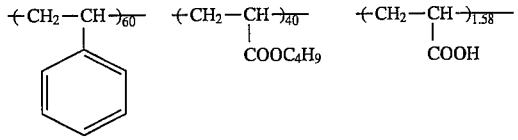 | |
| Hardener H-1 | 60 mg/m$^2$ |
| 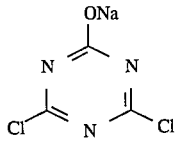 | |
| Silver halide emulsion A | 3.3 g/m$^2$ |
| S-1(sodium isoamyl-n-decylsulfosuccinate) | 0.64 mg/m$^2$ |
| 2-mercapto-6-hydroxypurine | 1.7 mg/m$^2$ |
| EDTA | 50 mg/m$^2$ |
| Prescription 2 (Emulsion protective layer composition) | |
| S-1 | 12 mg/m$^2$ |
| Matting agent:<br>monodisperse silica having an average<br>particle size of 3.5 μm | 22 mg/m$^2$<br>40 mg/m$^2$ |
| 1,3-vinylsulfonyl-2-propanol | |
| Surfactant | 0.6 mg/m$^2$ |
| 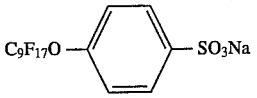 | |
| Prescription 3 (Backing layer composition) | |
| Saponin | 133 mg/m$^2$ |
| S-1 | 6 mg/m$^2$ |
| Colloid silica | 100 mg/m$^2$ |
| Dye | |
| (a)<br> 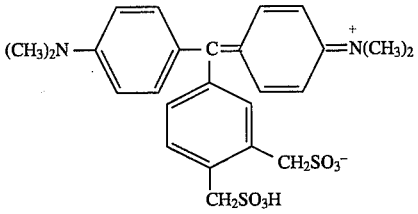 | 30 mg/m$^2$ |
| (b)<br> 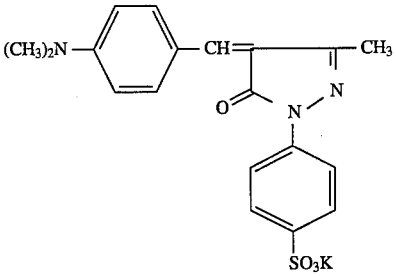 | 75 mg/m$^2$ |

-continued

| | |
|---|---|
| (c) 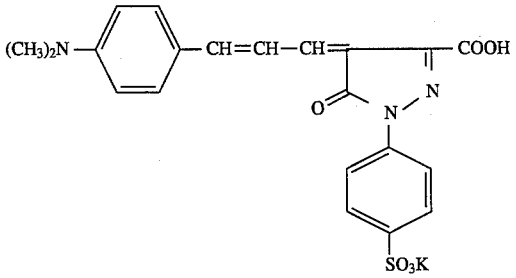 | 30 mg/m$^2$ |
| 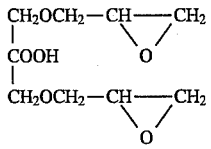 | 100 mg/m$^2$ |
| Compound of Formula (1) | shown in Table 2 |
| Prescription 4 (Backing protective layer composition) | |
| Matting agent: monodisperse polymethylmethacrylate having an average particle size of 5.0 μm | 50 mg/m$^2$ |
| Sodium di-(2-ethylhexyl)sulfosuccinate | 10 mg/m$^2$ |
| The prescriptions of developer and fixer will be described below. | |
| (Prescription of Developer) | |
| Sodium sulfite | 55 g/liter |
| Sodium carbonate | 40 g/liter |
| Hydroquinone | 24 g/liter |
| 4-methyl-4-hydroxymethyl-1-phenyl-3-pyrazolidone (Dimeson S) | 0.9 g/liter |
| Potassium bromide | 5 g/liter |
| 5-methyl-benzotriazole | 0.13 g/liter |
| Boric acid | 2.2 g/liter |
| Diethyleneglycol | 40 g/liter |
| 2-mercaptohypoxanthine | 60 mg/liter |
| Add water to make 1 liter and adjust pH with sodium hydroxide to be 10.5. | |
| (Prescription of Fixer) | |
| Composition A | |
| Ammonium thiosulfate (72.5% W/V solution) | 240 ml |
| Sodium sulfite | 17 g |
| Sodium acetate trihydrate | 6.5 g |
| Boric acid | 6.0 g |
| Citric acid bihydrate | 2.0 g |
| Composition B | |
| Pure water (deionized water) | 17 ml |
| Surfuric acid (aq. 50% W/V solution) | 4.7 g |
| Aluminum sulfate (an aqueous 8.1% W/V solution converted into an $Al_2O_3$ content) | 26.5 g |

The above compositions A and B were dissolved in 500 ml and water was added to make 1 liter. The resulting solution was adjusted with acetic acid to be pH 4.8.

The 610×590 mm light sensitive material 1 was processed at a rate of 200 sheets per day for succesive 10 days with the above developer and fixer using an automatic developing machine GR-26SR (produced by Konica Corporation). The light sensitive material was processed at a rate of unexposed one 4:exposed one 1. The processing was carried out for a replenishing amount of developer replenisher of 50, 100, 160 and 200 ml/m$^2$. The developer replenisher was the same as the above developer. The processing condition will be shown below.

Processing condition (light sensitive material 1)

| (Processing step) | (Temperature) | (Time) |
|---|---|---|
| Developing | 35° C. | 15 seconds |
| Fixing | 36° C. | 12 seconds |
| Washing | room temp. | 10 seconds |
| Drying | 50° C. | 10 seconds |

The silver concentration of the resulting developer was measured.

The light sensitive material 1 was exposed to a UV light through a contact screen having a 50 % dot, developed the exposed material, and evaluated using a magnifier for dot quality according to the following criteria.

5: excellent

4: good

3: fair

2: poor

1: very poor

The materials evaluated as 2 or 1 cannot be put into practical use.

The results are shown in Table 1.

TABLE 1

| Light sensitive material 1 Sample No. | Compound of Formula 1 | Content (mg/m²) | Replenishing amount of developer replenisher (ml) 50 a | 50 b | 100 a | 100 b | 160 a | 160 b | 200 a | 200 b | Remarks |
|---|---|---|---|---|---|---|---|---|---|---|---|
| 1-1 | None | — | 34.5 | 3 | 28.7 | 3 | 23.1 | 3 | 18.7 | 3 | Comp. |
| 1-2 | [A-4] | 3 | 33.3 | 3 | 27.4 | 3 | 22.5 | 3 | 18.1 | 3 | Comp. |
| | | 5 | 5.6 | 4 | 5.2 | 4 | 4.9 | 4 | 4.7 | 4 | Inv. |
| | | 10 | 4.5 | 4 | 4.3 | 4 | 4.1 | 4 | 4.0 | 5 | Inv. |
| | | 100 | 1.3 | 4 | 1.3 | 5 | 1.2 | 5 | 1.2 | 5 | Inv. |
| | | 200 | 0.6 | 4 | 0.5 | 5 | 0.5 | 5 | 0.4 | 5 | Inv. |
| | | 210 | 0.6 | 2 | 0.6 | 3 | 0.6 | 3 | 0.5 | 3 | Comp. |
| 1-3 | [B-35] | 3 | 32.9 | 3 | 27.3 | 3 | 21.7 | 3 | 17.8 | 3 | Comp. |
| | | 5 | 5.3 | 4 | 5.0 | 4 | 4.8 | 4 | 4.5 | 4 | Inv. |
| | | 10 | 4.4 | 4 | 4.2 | 4 | 4.1 | 5 | 3.9 | 5 | Inv. |
| | | 100 | 1.3 | 4 | 1.2 | 5 | 1.2 | 5 | 1.1 | 5 | Inv. |
| | | 200 | 0.5 | 4 | 0.5 | 5 | 0.4 | 5 | 0.4 | 5 | Inv. |
| | | 210 | 0.6 | 2 | 0.6 | 3 | 0.5 | 3 | 0.5 | 3 | Comp. |
| 1-4 | [g-27] | 3 | 32.5 | 3 | 26.5 | 3 | 19.8 | 3 | 16.1 | 3 | Comp. |
| | | 5 | 4.4 | 4 | 4.2 | 4 | 4.0 | 5 | 3.7 | 5 | Inv. |
| | | 10 | 3.7 | 4 | 3.5 | 4 | 3.0 | 5 | 2.9 | 5 | Inv. |
| | | 100 | 1.3 | 4 | 1.2 | 5 | 1.2 | 5 | 1.0 | 5 | Inv. |
| | | 200 | 0.5 | 4 | 0.5 | 5 | 0.4 | 5 | 0.4 | 5 | Inv. |
| | | 210 | 0.7 | 2 | 0.6 | 3 | 0.6 | 3 | 0.5 | 3 | Comp. |
| 1-5 | [g-13] | 3 | 32.6 | 3 | 26.9 | 3 | 20.8 | 3 | 16.8 | 3 | Comp. |
| | | 5 | 4.6 | 4 | 4.5 | 4 | 4.3 | 5 | 3.9 | 5 | Inv. |
| | | 10 | 3.8 | 4 | 3.5 | 4 | 3.4 | 5 | 3.3 | 5 | Inv. |
| | | 100 | 1.4 | 4 | 1.4 | 5 | 1.3 | 5 | 1.1 | 5 | Inv. |
| | | 200 | 0.5 | 4 | 0.5 | 5 | 0.4 | 5 | 0.4 | 5 | Inv. |
| | | 210 | 0.6 | 2 | 0.6 | 3 | 0.6 | 3 | 0.5 | 3 | Comp. |

a: Silver content (ppm) in the developer
b: Dot quality

As is apparent from Table 1, the present invention makes it possible in the rapid processing condition to reduce a replenishing amount of developer replenisher and to markedly prevent silver staining due to less silver dissolved.

Further, it has been proved that the inventive samples gives excellent dot quality compared with comparative samples.

Light sensitive material 2 was running processed in the same manner as in Example 1, except that the light sensitive material was processed at a rate of unexposed one 1:exposed one 1 and under the processing condition as shown below.

| Processing condition (light sensitive material 2) | | |
|---|---|---|
| (Processing step) | (Temperature) | (Time) |
| Developing | 35° C. | 30 seconds |
| Fixing | 33° C. | 20 seconds |
| Washing | room temp. | 20 seconds |
| Drying | 40° C. | 40 seconds |

The silver concentration of the resulting developer was measured.

The processed light sensitive materials were evaluated for black spots and dot quality.

Black spots were observed by means of a microscope, and evaluated according to the following criteria.

5: excellent

4: good

3: fair

2: poor

1: very poor

The materials evaluated as 2 or 1 cannot be put into practical use.

The light sensitive material 2 was exposed to a He—Ne light for 10–6 seconds through a contact screen having a 50% dot, developed the exposed material, and evaluated using a magnifier for dot quality according to the following criteria.

5: excellent

4: good

3: fair

2: poor

1: very poor

The materials evaluated as 2 or 1 cannot be put into practical use.

The results are shown in Table 2.

TABLE 2

| Light sensitive material Sample No. | Compound of Formula 1 | Content (mg/m²) | Replenishing amount of developer replenisher (ml) 50 a | 50 b | 50 c | 100 a | 100 b | 100 c | 160 a | 160 b | 160 c | 200 a | 200 b | 200 c | Remarks |
|---|---|---|---|---|---|---|---|---|---|---|---|---|---|---|---|
| 2-1 | None | — | 40.7 | 2 | 1 | 35.4 | 2 | 1 | 29.4 | 2 | 1 | 24.7 | 3 | 2 | Comp. |
| 2-2 | [A-4] | 3 | 39.1 | 2 | 1 | 33.8 | 2 | 1 | 28.4 | 2 | 1 | 23.1 | 3 | 2 | Comp. |
| | | 5 | 7.5 | 3 | 3 | 7.1 | 3 | 4 | 6.5 | 4 | 4 | 6.3 | 4 | 4 | Inv. |
| | | 10 | 6.0 | 4 | 4 | 5.4 | 4 | 4 | 5.1 | 5 | 4 | 5.0 | 5 | 5 | Inv. |
| | | 100 | 3.8 | 4 | 4 | 3.6 | 5 | 4 | 3.3 | 5 | 5 | 2.9 | 5 | 5 | Inv. |
| | | 200 | 1.9 | 5 | 5 | 1.9 | 5 | 5 | 1.8 | 5 | 5 | 1.7 | 5 | 5 | Inv. |
| | | 210 | 2.4 | 2 | 2 | 2.5 | 2 | 2 | 2.4 | 2 | 2 | 3.0 | 2 | 2 | Comp. |
| 2-3 | [B-35] | 3 | 38.7 | 2 | 1 | 33.4 | 2 | 1 | 27.9 | 2 | 1 | 22.8 | 2 | 2 | Comp. |
| | | 5 | 7.3 | 3 | 3 | 7.0 | 3 | 4 | 6.6 | 4 | 4 | 6.1 | 4 | 4 | Inv. |
| | | 10 | 5.2 | 4 | 4 | 4.7 | 4 | 4 | 4.7 | 5 | 4 | 4.5 | 5 | 5 | Inv. |
| | | 100 | 3.5 | 4 | 4 | 3.2 | 5 | 4 | 2.9 | 5 | 5 | 2.6 | 5 | 5 | Inv. |
| | | 200 | 1.8 | 5 | 5 | 1.7 | 5 | 5 | 1.5 | 5 | 5 | 1.5 | 5 | 5 | Inv. |
| | | 210 | 2.2 | 2 | 2 | 2.3 | 2 | 2 | 2.2 | 2 | 2 | 2.1 | 2 | 2 | Comp. |
| 2-4 | [g-27] | 3 | 36.5 | 2 | 1 | 31.4 | 2 | 1 | 25.7 | 2 | 1 | 20.5 | 2 | 2 | Comp. |
| | | 5 | 6.9 | 3 | 3 | 6.5 | 3 | 4 | 5.9 | 4 | 4 | 5.3 | 4 | 4 | Inv. |
| | | 10 | 4.8 | 4 | 4 | 4.4 | 4 | 4 | 4.3 | 5 | 5 | 4.0 | 5 | 5 | Inv. |
| | | 100 | 2.5 | 4 | 4 | 2.4 | 5 | 4 | 2.4 | 5 | 5 | 4.0 | 5 | 5 | Inv. |
| | | 200 | 1.4 | 5 | 5 | 1.4 | 5 | 5 | 1.3 | 5 | 5 | 1.3 | 5 | 5 | Inv. |
| | | 210 | 1.9 | 2 | 2 | 2.0 | 2 | 2 | 2.0 | 2 | 2 | 2.0 | 2 | 2 | Comp. |
| 2-5 | [g-13] | 3 | 37.8 | 2 | 1 | 32.5 | 2 | 1 | 26.2 | 2 | 1 | 21.6 | 2 | 2 | Comp. |
| | | 5 | 7.4 | 3 | 3 | 6.8 | 3 | 4 | 6.0 | 4 | 4 | 5.6 | 4 | 4 | Inv. |
| | | 10 | 5.2 | 4 | 4 | 4.8 | 4 | 4 | 4.7 | 5 | 5 | 4.3 | 5 | 5 | Inv. |
| | | 100 | 2.7 | 4 | 4 | 2.6 | 5 | 4 | 2.6 | 5 | 5 | 2.4 | 5 | 5 | Inv. |
| | | 200 | 1.6 | 5 | 5 | 1.6 | 5 | 5 | 1.5 | 5 | 5 | 1.4 | 5 | 5 | Inv. |
| | | 210 | 2.5 | 2 | 2 | 2.5 | 2 | 2 | 3.0 | 2 | 2 | 2.0 | 2 | 2 | Comp. |

a: Silver content (ppm) in the developer
b: Dot quality
c: Black spots

As is apparent from Table 2, the present invention makes it possible to markedly prevent silver staining due to less silver dissolved even when a light sensitive material was processed with a reduced replenishing amount (not more than 200 ml/m²) of developer replenisher.

Further, it has been proved that the inventive samples gives excellent dot quality and prevention of black spots compared with comparative samples.

What is claimed is:

1. A method of processing a black and white photographic light-sensitive material comprising a support, a silver halide emulsion layer provided thereon, and a backing layer on the support opposite the emulsion layer, the emulsion layer containing a hydrazine compound represented by Formula (2)

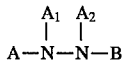

Formula (2)

wherein A is aliphatic, aryl, or heterocyclic, B is acyl, alkylsulfonyl, arylsulfonyl, alkylsulfinyl, arylsulfinyl, carbamoyl, alkoxycarbonyl, aryloxycarbonyl, sulfamoyl, sulfinamoyl, alkoxysulfonyl, thioacyl, thiocarbamoyl, oxalyl, or heterocyclic; alternatively, B, $A_2$ and the nitrogen atom to which both are bonded may combine to form —N=C($R_9$)($R_{10}$) in which $R_9$ is alkyl, aryl, or heterocyclic, and $R_{10}$ is hydrogen, alkyl, aryl, or heterocyclic; and $A_1$ and $A_2$ are both hydrogen, or one of $A_1$ and $A_2$ is hydrogen and the other is acyl, sulfonyl, or oxalyl, the method comprising exposing the material;

developing the exposed material with developer, said developer being replenished with developer replenisher in an amount of not more than 200 ml per m² of the material; and fixing the developed material, wherein the backing layer contains in an amount of 5 to 200 mg/m² of a compound selected from the group consisting of compounds represented by the following Formulas (A), (B), and (C):

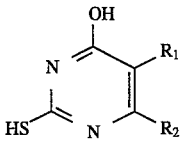

Formula (A)

wherein $R_1$ and $R_2$ independently represent an alkyl, aryl, aralkyl, hydroxy, carboxy, sulfo, phosphono, amino, nitro, cyano, alkoxycarbonyl, aryloxycarbonyl, carbamoyl, sulfamoyl or alkoxy group or a halogen atom, provided that $R_1$ and $R_2$ may combine to form a ring,

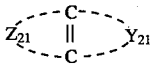

Formula (B)

wherein $Z_{21}$ and $Y_{21}$ independently represent an atomic group necessary to form an unsaturated 5- or 6-membered ring, provided that three or more nitrogen atoms are contained in $Z_{21}$ and $Y_{21}$ and one of $Z_{21}$ and $Y_{21}$ has a mercapto group as a substituent,

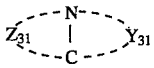

Formula (C)

wherein $Z_{31}$ and $Y_{31}$ independently represent an atomic group necessary to form an unsaturated 5- or 6-membered ring, provided that three or more nitrogen atoms are contained in $Z_{31}$ and $Y_{31}$ and one of $Z_{31}$ and $Y_{31}$ has a mercapto group as a substituent.

2. A method of claim 1, wherein the content of said hydrazine compound is $5\times10^{-6}$ to $5\times10^{-2}$ mol/mol of silver.

3. The method of claim 1, wherein the backing layer contains said compound in an amount of 7 to 150 mg/m$^2$.

4. The method of claim 1, wherein said developer is replenished with developer replenisher in an amount of 50 to 160 ml per m$^2$ of the material.

5. The method of claim 1, wherein the total processing time is 15 to 60 seconds.

6. The method of claim 1, wherein the content of said hydrazine compound is $5\times10^{-7}$ to $5\times10^{-1}$ mol/mol of silver.

* * * * *